US009976264B2

(12) United States Patent
Grumberg et al.

(10) Patent No.: US 9,976,264 B2
(45) Date of Patent: May 22, 2018

(54) WORK PLATFORM SYSTEM INCLUDING SUSPENDED PANELED PORTION AND METHOD OF IMPLEMENTING SAME

(71) Applicant: Safway Services, LLC, Waukesha, WI (US)

(72) Inventors: Mathieu Grumberg, Delmar, NY (US); Roy Scrafford, Scotia, NY (US); Frederick W. Meade, North Creek, NY (US)

(73) Assignee: SAFWAY SERVICES, LLC, Waukesha, WI (US)

( * ) Notice: Subject to any disclaimer, the term of this patent is extended or adjusted under 35 U.S.C. 154(b) by 0 days. days.

(21) Appl. No.: 13/899,331

(22) Filed: May 21, 2013

(65) Prior Publication Data

US 2014/0345976 A1 Nov. 27, 2014

(51) Int. Cl.
*E04G 3/30* (2006.01)
*E01D 19/10* (2006.01)
(Continued)

(52) U.S. Cl.
CPC ..... *E01D 19/106* (2013.01); *E04C 3/09* (2013.01); *E04G 1/152* (2013.01); *E04G 3/22* (2013.01);
(Continued)

(58) Field of Classification Search
CPC .. E04G 3/30; E04G 5/08; E04G 1/153; E01D 19/106
See application file for complete search history.

(56) References Cited

U.S. PATENT DOCUMENTS 629,935 A 8/1899 Sturgis
779,019 A 1/1905 Agobian
(Continued)

FOREIGN PATENT DOCUMENTS

EP 0611856 A1 * 8/1994 ..... E04G 3/20
EP 0702120 A1 9/1995
(Continued)

OTHER PUBLICATIONS

International Search Report and Written Opinion for PCT/GB2012/052664 dated Mar. 12, 2013, 12 pages.
(Continued)

*Primary Examiner* — Alvin C Chin-Shue
(74) *Attorney, Agent, or Firm* — Husch Blackwell LLP

(57) ABSTRACT

A work platform system for implementation in relation to a structure, as well as subsystems and components thereof and methods of implementation and use relating thereto, are disclosed herein. In at least one embodiment, the work platform system includes a first pair of flexible elements and a second pair of flexible elements, where a respective first end of each of the flexible elements is coupled at least indirectly to a first support component and a respective second end of each of the flexible elements is coupled at least indirectly to a second support component. The work platform system can further include a plurality of panel structures supported upon the flexible elements, a suspension component, and a clamp structure coupled to at least one of the first pair of flexible elements and the second pair of flexible elements. The work platform system can include one or more support extension.

50 Claims, 17 Drawing Sheets

(51) Int. Cl.

| | |
|---|---|
| ***E04G 1/15*** | (2006.01) |
| ***E04G 3/22*** | (2006.01) |
| ***E04G 7/28*** | (2006.01) |
| ***E04C 3/09*** | (2006.01) |
| *E04C 3/04* | (2006.01) |

(52) U.S. Cl.
CPC ..... *E04G 3/30* (2013.01); *E04G 7/28* (2013.01); *E04C 2003/0491* (2013.01)

(56) References Cited

U.S. PATENT DOCUMENTS

| | | | | |
|---|---|---|---|---|
| 928,367 | A | 7/1909 | DeWitt | |
| 1,027,234 | A | 5/1912 | Belcher | |
| 1,598,349 | A | 8/1926 | Hitt | |
| 2,198,960 | A | 4/1940 | Deck | |
| 2,997,767 | A | 8/1961 | Grover et al. | |
| 3,023,834 | A * | 3/1962 | Buchanan | 182/223 |
| 3,301,147 | A * | 1/1967 | Clayton et al. | 404/35 |
| 4,143,446 | A | 3/1979 | Down | |
| 4,660,680 | A | 4/1987 | Potin | |
| 4,894,967 | A | 1/1990 | Morton | |
| 5,011,710 | A | 4/1991 | Harrison | |
| 5,299,655 | A | 4/1994 | Margaritis | |
| 5,417,026 | A | 5/1995 | Brumfield | |
| 5,730,245 | A | 3/1998 | Conway | |
| 5,730,248 | A * | 3/1998 | Apostolopoulos | 182/150 |
| 5,911,288 | A * | 6/1999 | Zafirakis | 182/150 |
| 5,921,346 | A | 7/1999 | Apostolopoulos | |
| 5,957,239 | A | 9/1999 | Marshak | |
| 6,003,634 | A | 12/1999 | Apostolopoulos | |
| 6,135,240 | A | 10/2000 | Apostolopoulos | |
| 6,138,793 | A | 10/2000 | Apostolopoulos | |
| 6,227,331 | B1 | 5/2001 | Apostolopoulos | |
| 6,264,002 | B1 | 7/2001 | Apostolopoulos | |
| 6,302,237 | B1 | 10/2001 | Apostolopoulos | |
| 6,386,319 | B2 | 5/2002 | Apostolopoulos | |
| 6,523,644 | B2 | 2/2003 | Apostolopoulos | |
| 6,530,456 | B1 | 3/2003 | Wallther | |
| 6,745,871 | B2 * | 6/2004 | Armstrong | 182/222 |
| 6,817,444 | B1 | 11/2004 | Shinas | |
| 7,032,712 | B2 | 4/2006 | Schworer | |
| 7,234,689 | B2 | 6/2007 | Kuenzel | |
| 7,500,336 | B2 * | 3/2009 | McGivern et al. | 52/650.3 |
| 7,779,599 | B2 | 8/2010 | Jolicoeur et al. | |
| 7,941,986 | B2 | 5/2011 | Jolicoeur et al. | |
| 8,123,001 | B1 | 2/2012 | Apostolopoulos et al. | |
| 8,739,489 | B2 | 6/2014 | Weber et al. | |
| 8,910,442 | B2 | 12/2014 | Lachevrotiere et al. | |
| 9,103,081 | B1 | 8/2015 | Mangin | |
| 9,217,451 | B2 | 12/2015 | Apostolopoulos et al. | |
| 9,309,633 | B2 | 4/2016 | Apostolopoulos et al. | |
| 2001/0040070 | A1 | 11/2001 | Apostolopoulos | |
| 2002/0029932 | A1 | 3/2002 | Apostolopoulos | |
| 2002/0092706 | A1 | 7/2002 | Apostolopoulos | |
| 2003/0127287 | A1 | 7/2003 | Apostolopoulos | |
| 2004/0117928 | A1 | 6/2004 | Apostolopoulos | |
| 2005/0217936 | A1 * | 10/2005 | Jolicoeur et al. | 182/130 |
| 2008/0277200 | A1 | 11/2008 | Houlihan et al. | |
| 2010/0011679 | A1 | 1/2010 | Monaco et al. | |
| 2011/0010913 | A1 | 1/2011 | Jolicoeur et al. | |
| 2011/0085854 | A1 * | 4/2011 | Apostolopoulos et al. | 403/399 |
| 2011/0214945 | A1 | 9/2011 | Jolicoeur et al. | |
| 2014/0202087 | A1 | 7/2014 | Jolicoeur et al. | |
| 2014/0251730 | A1 | 9/2014 | Bisset | |
| 2016/0186393 | A1 | 6/2016 | Apostolopoulos et al. | |

FOREIGN PATENT DOCUMENTS

| | | | |
|---|---|---|---|
| EP | 1031677 | A2 | 8/2000 |
| EP | 2298998 | A2 | 3/2011 |
| FR | 2527251 | | 5/1982 |
| FR | 2584761 | A3 | 1/1987 |
| GB | 2074225 | A | 10/1981 |
| GB | 2396652 | A | 3/2003 |
| GB | 2459181 | A | 10/2009 |
| GB | 2498963 | A | 8/2013 |
| GB | 2500025 | A | 9/2013 |
| GB | 2501227 | A | 10/2013 |
| GB | 2511847 | A | 9/2014 |
| JP | 2002138660 | A | 5/2002 |
| JP | 2004084261 | A | 3/2004 |
| JP | 2008215031 | A | 9/2008 |
| WO | WO2003025311 | A1 | 3/2003 |
| WO | WO2009127818 | A1 | 10/2009 |
| WO | 2010/108882 | A1 | 9/2010 |
| WO | WO2012072982 | A1 | 6/2012 |
| WO | WO2013002790 | | 1/2013 |
| WO | WO2013061072 | | 5/2013 |
| WO | WO2013122607 | A1 | 8/2013 |
| WO | WO2014189498 | | 11/2014 |
| WO | WO2014189539 | | 11/2014 |
| WO | WO2014189962 | | 11/2014 |

OTHER PUBLICATIONS

International Search Report and Written Opinion for PCT/US2013/042084 dated Jun. 12, 2014, 6 pages.
International Search Report and Written Opinion for PCT/ US2014/038832 dated Aug. 1, 2014, 13 pages.
International Search Report for PCT/US2013/063234 dated Jul. 3, 2014, 6 pages.
United States Department of Labor, Occupational Safety & Health Administration, Suspended Scaffolds—Catenary, url: https://www.osha.gov/SLTC/etools/scaffolding/suspended/catenary.html, printed Mar. 12, 2015, 2 pages.
Gartner, World of Asphalt 2015 Show & Conference, New Platform System Used to Rehabilitate Bridges, 7 pages, Dec. 28, 2000.
Restriction Requirement for U.S. Appl. No. 14/045,308 dated Feb. 24, 2015, 9 pages.
Web Rigging Services Ltd., Case Study, 2 pages.
Web Net—Tension Netting System, Web Rigging Services Ltd., retrieved from url: http://www.webrsl.co.uk/content/web-net.php.
International Search Report and Written Opinion for PCT/US2013/063234 dated Nov. 24, 2015, 17 pages.
Notice of Reasons for Rejection for Japanese Patent Application No. 2016-515027 dated Feb. 7, 2018.

* cited by examiner

FIG. 7
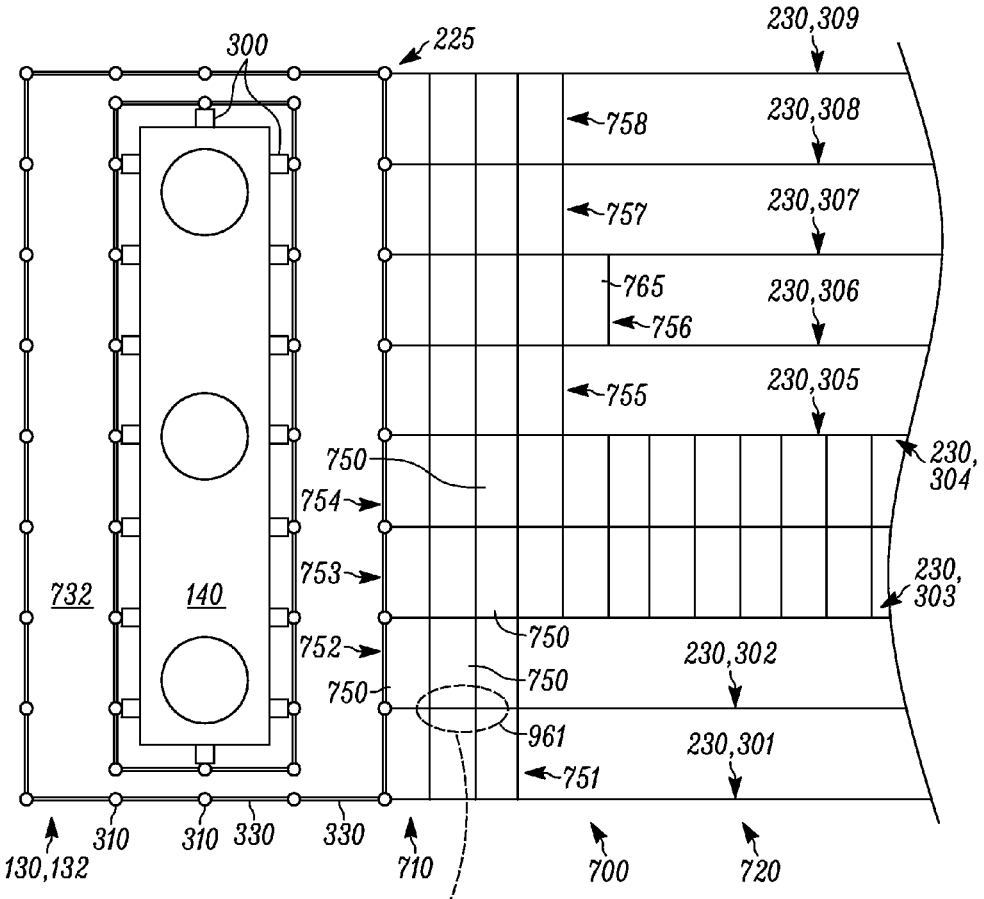
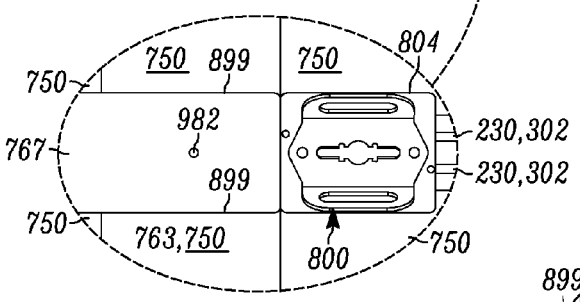
FIG. 7A
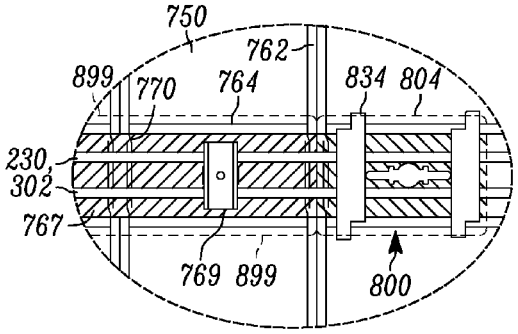
FIG. 7B

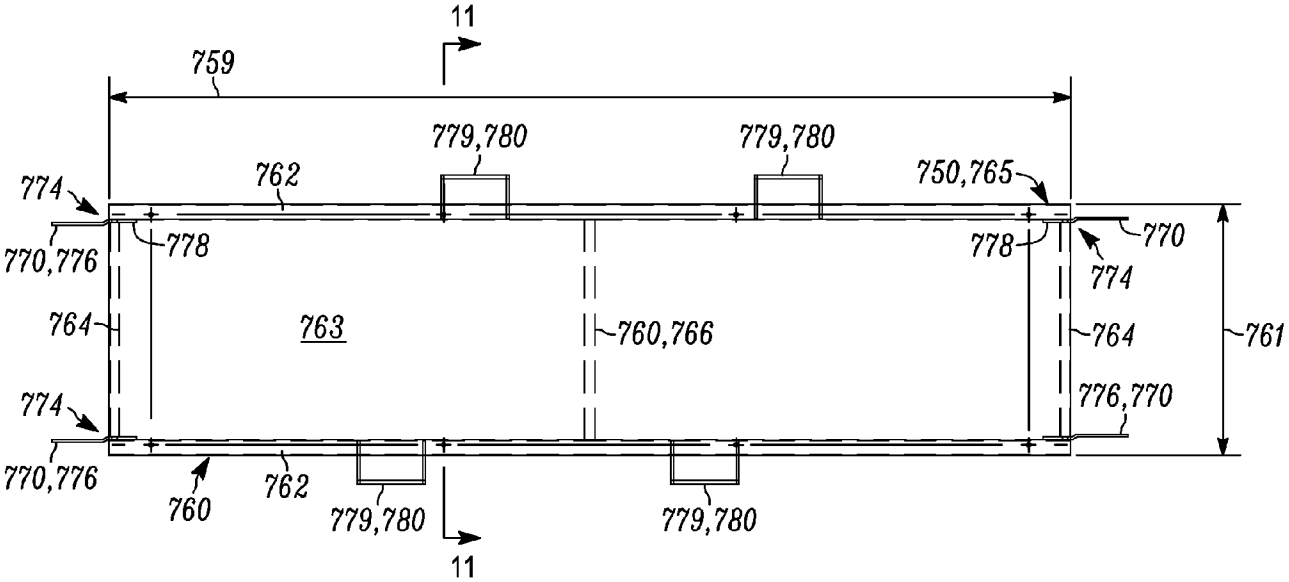
FIG. 8
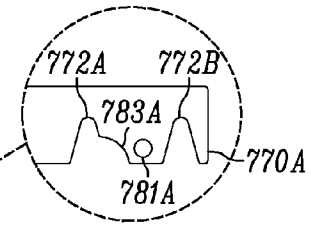
FIG. 9A
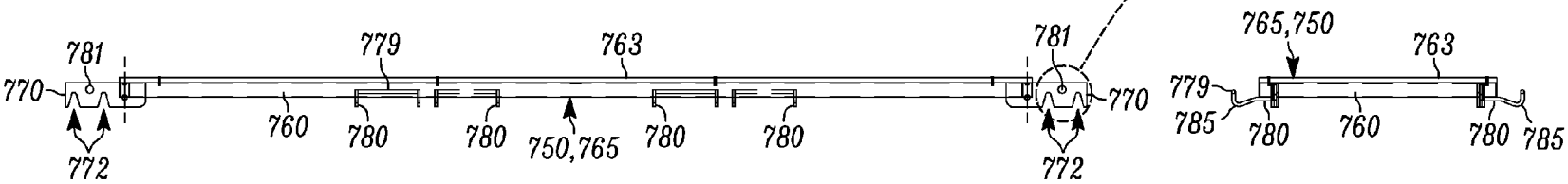
FIG. 9
FIG. 10

WORK PLATFORM SYSTEM INCLUDING SUSPENDED PANELED PORTION AND METHOD OF IMPLEMENTING SAME

FIELD OF THE INVENTION

The present invention relates, generally, to the field of work platform systems that are erected to facilitate accessing of various parts of various structures. More particularly, the present invention relates to work platform systems that are capable of being erected to extend lengthwise over significant distances between end regions, where the work platform systems further extend beneath at least some portions of the structures with respect to which the work platform systems are facilitating access.

BACKGROUND OF THE INVENTION

A number of types of work platform systems are available on the market for use in a variety of environments, circumstances, and projects including, for example, construction or maintenance projects. Whether a project is a public works project (e.g., low bid), or a private project, reducing costs and/or maintaining costs at reasonable levels are important considerations for the parties involved (e.g., contractors and/or the owner). One environment in which work platform systems are used is along and particularly beneath structures that extend significant distances lengthwise, such as bridges. Such work platform systems can be employed for various reasons including, for example, to allow workers to perform various maintenance procedures (such as inspecting, cleaning, painting, repairing, or refurbishing) or construction procedures with respect to the structures, particularly in relation to regions along or proximate underside regions of the structures such as along the undersides of bridges. Also, such work platform systems can serve to perform a shielding function in terms of limiting the extent to which debris arising from such maintenance or construction procedures or otherwise can fall to regions beneath the work platform systems.

Various conventional work platform systems exist that can be implemented in such environments, and these various work platform systems vary in a number of their attributes. At least some such conventional work platform systems are catenary-based systems in which deck portions are mounted on wires that extend between end regions of the overall work platform systems, where the wires are further suspended at various intervals along the lengths of the wires by way of additional supports.

Although some such catenary-based systems can be relatively inexpensive to implement, at least some of these systems can be disadvantageous in certain respects. Among other things, one or more conventional catenary-based systems can be relatively difficult to erect or require conditions (e.g., lane closure) or expertise for proper implementation that are difficult to obtain or guarantee. Also, one or more conventional catenary-based systems are made of components that are limited in terms of lifespan or reusability, and/or employ components that lack sufficient durability or stability or are ergonomically undesirable for other reasons. Further, at least some such conventional systems provide walking surfaces that lack desired levels of flatness (e.g., the walking surfaces bend or experience excessive undulation).

For at least these reasons, therefore, it would be advantageous if a new or improved work platform system and/or method of use (e.g., in terms of installing the work platform system) could be developed that addressed one or more of the above-described concerns, and/or other concerns.

SUMMARY OF THE INVENTION

In at least some exemplary embodiments, the present invention relates to a work platform system for implementation in relation to a structure. The work platform system includes a first flexible element and a second flexible element, where a respective first end of each of the flexible elements is coupled at least indirectly to a first support component and a respective second end of each of the flexible elements is coupled at least indirectly to a second support component. The work platform system also includes a plurality of panel structures supported upon the flexible elements and substantially extending between the first flexible element and the second flexible element, wherein the panel structures are positioned in succession with one another so as to form a row of the panel structures extending along the flexible elements. Each of the panel structures includes a first pair of opposed edges each extending substantially parallel to the flexible elements and a second pair of opposed edges each extending between the first pair of opposed edges. A first of the panel structures includes a first support extension extending outward away from a first one of the respective second pair of opposed edges of the first panel structure. Additionally, the first support extension of the first panel structure includes a first formation into which a second one of the respective second pair of opposed edges of a second of the panel structures is positioned, the first formation serving to at least partly limit movement of the second panel structure relative to the first panel structure.

Additionally, in at least some embodiments, the present invention relates to a work platform system for implementation in relation to a structure. The work platform system includes a first pair of flexible elements and a second pair of flexible elements, where a respective first end of each of the flexible elements is coupled at least indirectly to a first support component and a respective second end of each of the flexible elements is coupled at least indirectly to a second support component. The work platform system also includes a plurality of panel structures supported upon the flexible elements and substantially extending between the first pair of flexible elements and the second pair of flexible elements, where the panel structures are positioned in succession with one another so as to form a row of the panel structures extending along the flexible elements. Each of the panel structures includes a first pair of opposed edges each extending substantially parallel to the flexible elements and a second pair of opposed edges each extending between the first pair of opposed edges. A first of the panel structures includes a first support extension extending outward away from a first one of the respective second pair of opposed edges of the first panel structure. Additionally, the first support extension of the first panel structure includes a first formation into which a second one of the respective second pair of opposed edges of a second of the panel structures is positioned, the first formation serving to at least partly limit movement of the second panel structure relative to the first panel structure.

Additionally, in at least some embodiments, the present invention relates to a work platform system for implementation in relation to a structure. The work platform system includes a first pair of flexible elements and a second pair of flexible elements, where a respective first end of each of the flexible elements is coupled at least indirectly to a first support component and a respective second end of each of the flexible elements is coupled at least indirectly to a second support component. The work platform system further includes a plurality of panel structures supported upon the flexible elements, a suspension component, and a clamp structure coupled to at least one of the first pair of flexible elements and the second pair of wire extensions so that the at least one of the first pair of wire extensions and the second pair of wire extensions is or are supported by the suspension component. The clamp structure includes at least a primary surface formation and a clasp component that is rotatably attached to the primary surface formation, but locked in place relative to the primary surface formation.

Further, in at least some embodiments, the present invention relates to a method of implementing a work platform system in relation to a structure. The method includes attaching a first pair of flexible elements and a second pair of flexible elements at least indirectly to a first support and a second support, respectively, and installing a first panel section onto the first and second pairs of flexible elements. The method also includes installing a second panel section onto the first and second pairs of flexible elements, where the installing of the second panel section includes placement of a second side edge of the second panel section into at least one support component extending outward from a first side edge of the first panel section and rotating the second panel section until the second panel is supported on the first and second pairs of wire extensions. The method additionally includes determining whether at least one suspension component should be installed in relation to at least one of the first and second pairs of flexible elements and, if so, installing at least one clamp structure onto the at least one of the first and second pairs of flexible elements and coupling the at least one suspension wire to the at least one clamp structure.

BRIEF DESCRIPTION OF THE DRAWINGS

FIG. 7 is a top plan, partly cross-sectional view taken along line 7-7 of FIG. 12;

FIG. 7A is a detail view of a portion of the cross-sectional view of FIG. 7;

FIG. 7B is a further detail view of the portion of the partly-completed work platform system that is shown in FIG. 7A, but which shows that portion of the work platform system as it would be seen from underneath (rather than from above) the work platform system;

FIG. 8 is a top plan view of an example panel section included in the partly completed work platform system as shown in FIG. 7;

FIG. 9 is a front side elevation view of the panel section of FIG. 8;

FIG. 9A is a cutaway view of an alternate embodiment of a wire tendon support extension that can be employed in a panel section such as the panel section of FIG. 9;

FIG. 10 is a right end side elevation view of the panel section of FIG. 8;

DETAILED DESCRIPTION

Figure 1:
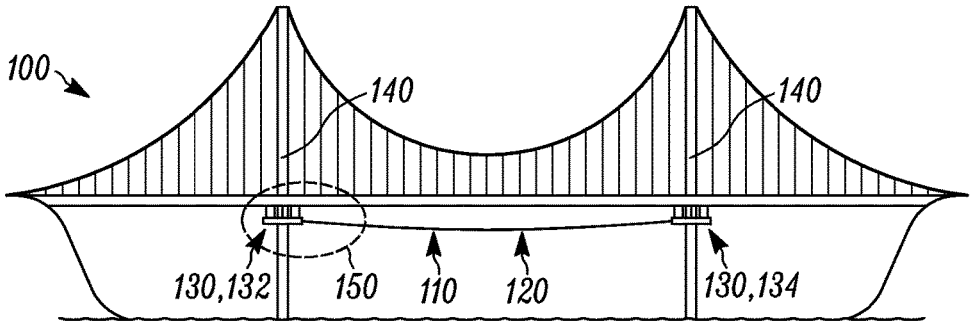
FIG. 1 is a side elevation view of an example bridge on which an example work platform system has been partly implemented.

Referring to FIG. 1, a side elevation view is provided of a suspension bridge 100 in combination with a partly implemented (or partly installed) work platform system 110 that is being implemented in relation to the suspension bridge for the purpose of allowing one or more work operations to be performed by work personnel in relation to the suspension bridge. It should be appreciated that the suspension bridge 100 is merely one example of a structure in relation to which a work platform system such as the partly implemented work platform system 110 (or that work platform system when in a different state of implementation as discussed further below) can be implemented and utilized. That said, the present disclosure is intended to encompass work platform systems and implementations of work platform systems in relation to any of a variety of structures rather than merely suspension bridges. Thus, although FIG. 1 shows the suspension bridge 100, it should be appreciated that the present disclosure is intended to encompass work platform systems and implementations of work platform systems in relation to a variety of other structures including, for example, other types of bridges such as arched bridges, buildings, towers, rigs (e.g., oil rigs), piers, conveyors, and other structures.

It is envisioned that at least some of the work platform systems disclosed herein are particularly suitable for use in relation to structures such as the suspension bridge 100, where it is desired that the work platform system extend significant distances along (and often underneath) the structure. To this end, the present disclosure particularly encompasses work platform systems that include both a respective support subsystem and a respective suspended subsystem that extends (and potentially extends significant distances) between portions of the support subsystem. In this regard, referring still to FIG. 1, it can be seen that the partly implemented work platform system 110, even when in the partly implemented state as shown, both includes a partly implemented suspended subsystem 120 as well as a support subsystem 130. As shown, the support subsystem 130 includes a first portion 132 and a second portion 134 that respectively are at opposite ends of the partly implemented suspended subsystem 120 and respectively supported upon respective towers 140 of the suspension bridge 100, with the partly suspended subsystem 120 extending between the portions 132 and 134 of the support subsystem 130.

It should be appreciated that, although FIG. 1 begins by showing the work platform system 110 in a partly implemented state, it will be apparent from additional description provided below as to how this work platform system (and particularly the suspended subsystem thereof) is further modified so as to include additional components and otherwise take on additional features so as to form a fully implemented work platform system as ultimately shown in FIG. 15. That is, although FIG. 1 (as well as FIGS. 2 and 3) shows an early stage of an implementation (installation) process of a work platform system in relation to the suspension bridge 100, during which the work platform system takes the form of the partly implemented work platform system 110, additional description provided below provides detail as to how the partly implemented work platform system 110 evolves into a fully implemented work platform system, which is ultimately shown in FIG. 15.

Figure 2:
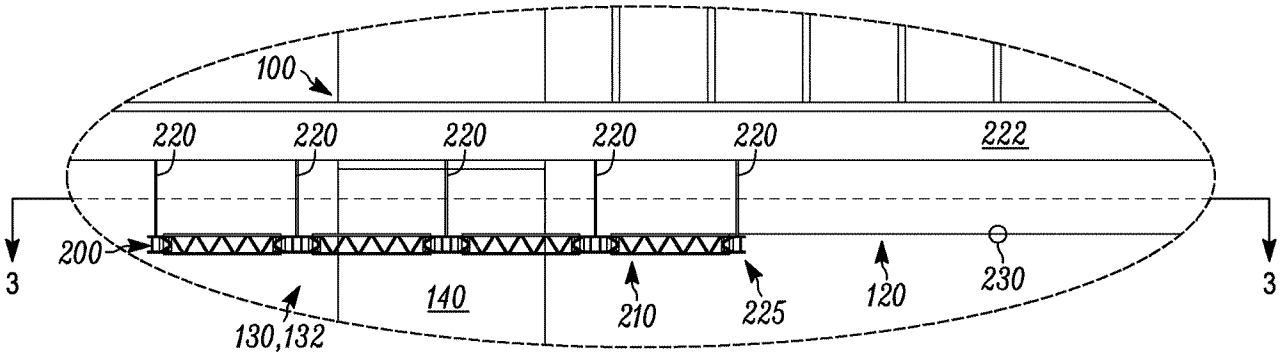
FIG. 2 is an enlarged detail view of a portion of the side elevation view of FIG. 1 that particularly shows, in addition to a portion of the example bridge shown in FIG. 1, a portion of a partly implemented suspended subsystem of the partly implemented work platform system of FIG. 1, in combination with a portion of a support subsystem of that partly implemented work platform system.

Referring additionally to FIG. 2, an enlarged detail view of a region or portion 150 of the side elevation view of FIG. 1 is provided, to show a portion of the suspension bridge 100 along with an assembly 200 of the first portion 132 of the support subsystem 130 and an additional portion of the partly implemented suspended subsystem 120 of the partly implemented work platform system 110. More particularly as shown in FIG. 2, in the present example in which the partly implemented work platform system 110 is being implemented in relation to the suspension bridge 100, the first portion 132 of the support subsystem 130 is implemented so as to be attached to and supported by a respective one of the towers (or piers) 140 of the bridge, with the partly implemented suspended subsystem 120 in turn being supported by that portion 132 of the support subsystem generally at a junction 225. Thus, in the detail view provided in FIG. 2, the first portion 132 of the support subsystem 130 is mounted on and supported by a first of the towers 140 of the bridge 100, albeit it should be understood (e.g., as shown in FIG. 1) that another substantially identical portion (the second portion 134) of the support subsystem is mounted on/supported by the other of the towers 140 (e.g., at another junction corresponding to the junction 225).

As discussed further in relation to FIG. 3, the first and second portions 132 and 134 of the support subsystem 130 are supported directly in relation to the towers 140 (e.g., by way of anchors as discussed below). However, in addition to such manner of support, as is evident from FIG. 2 (as well as from FIG. 1 upon close inspection), it should also be appreciated that in the present embodiment the first and second portions 132 and 134 of the support subsystem 130 are further supported by support chains 220. As shown, the support chains 220, which can be considered to constitute additional parts of the support subsystem 130, are connected to and extend downward from locations along a deck 222 of the suspension bridge 100 to locations along the main body of the support subsystem 130 (particularly to certain structural support components thereof, as discussed further below). The support chains 220 not only allow for suspension of the support subsystem 130 (particularly the main body of that support subsystem) in relation to the deck 222 of the suspension bridge 100, but also allow for implementation of the support subsystem 130 in relation to the suspension bridge. In particular, in the present embodiment it is envisioned that the support chains 220 are used to hoist the otherwise-fully-assembled portions 132 and 134 of the support subsystem 130 upward and into place at appropriate vertical levels along the towers 140, where the portions 132 and 134 are then anchored into place in relation to the towers by way of anchors as discussed below.

Figures 3, 3A:
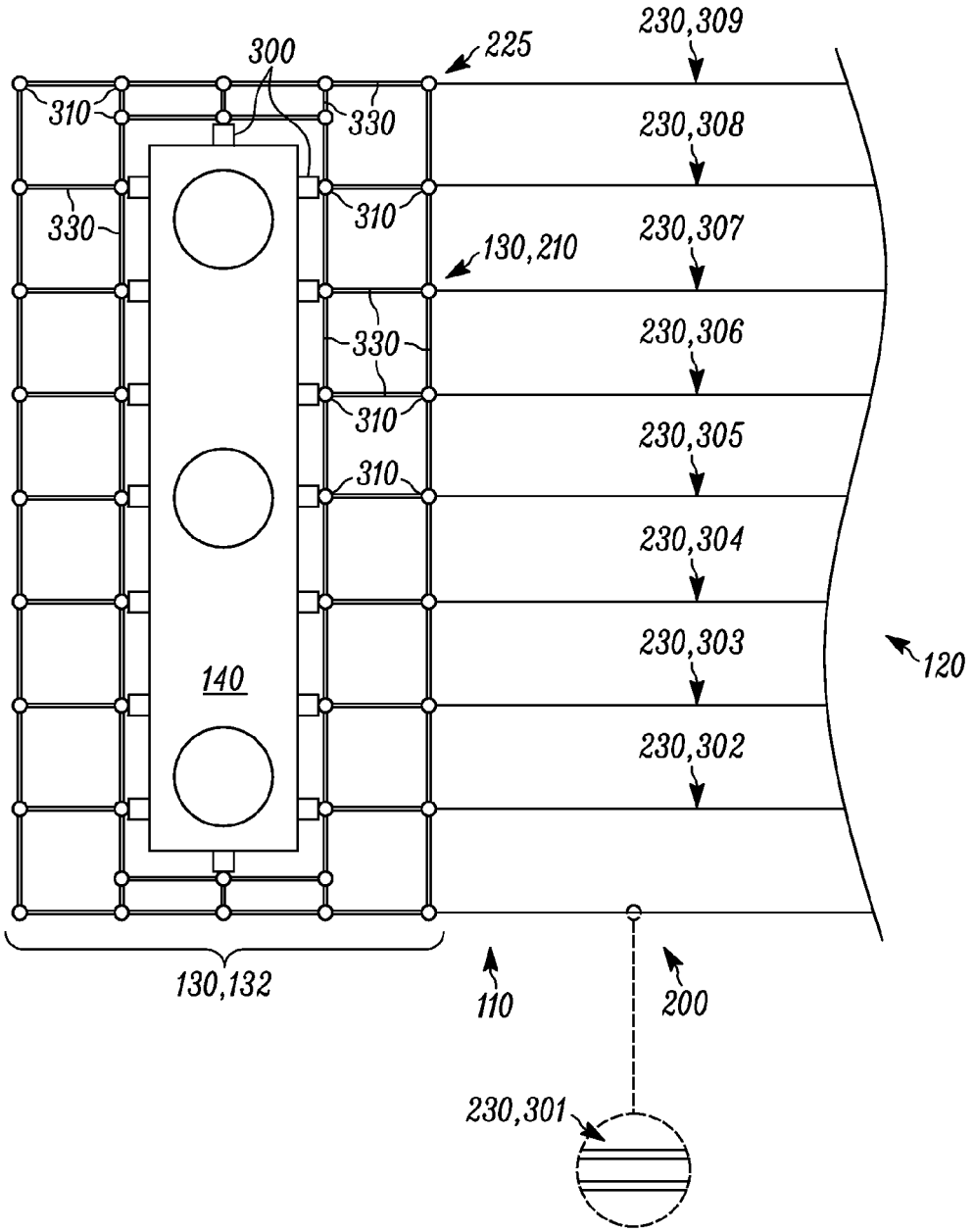
FIG. 3 is a top plan, partly cross-sectional view of the portion of the side elevation view of FIG. 1 shown in the detail view of FIG. 2, taken along line 3-3 of FIG. 2, except that in FIG. 3 the floor panels that are actually present in the support subsystem are not shown to be present, so as to reveal more clearly certain underlying structural support components of the support subsystem.
FIG. 3A is a detail view of a portion of the cross-sectional view of FIG. 3 showing a first pair of wire tendons included in the partly implemented support subsystem.

Referring additionally to FIG. 3, a top plan, partly cross-sectional view taken along a line 3-3 of FIG. 2 is provided, to further show a portion of the suspension bridge 100 in relation to the assembly 200 of FIG. 2. FIG. 3 particularly illustrates features of the portions of the partly implemented work platform system 110 that are included within the assembly 200. In this regard, FIG. 3 shows the first portion 132 of the partly implemented support subsystem 130 as extending fully around the first of the towers 140 of the suspension bridge 100. It will be understood that, although not shown in FIG. 3, the second portion 132 of the support subsystem 130, which is provided on the other of the towers 140 of the suspension bridge, similarly extends fully around that tower in the present embodiment. Further, even though in the present embodiment the first portion 132 and second portion 132 respectively extend entirely around the respective towers 140 in relation to which those portions are respectively positioned and/or supported, in alternate embodiments the first portion and/or the second portion (or some other platform or platform portion) need not encircle the respective tower (or pier or other structure) but rather can simply be positioned along and/or supported in relation a single side or a single region or portion of the respective tower (or pier or other structure).

Further, the partly implemented suspended subsystem 120 in the present embodiment is shown to include multiple pairs of wire tendons 230. More particularly, the pairs of wire tendons 230 in the present embodiment include first, second, third, fourth, fifth, sixth, seventh, eighth, and ninth pairs of wire tendons 301, 302, 303, 304, 305, 306, 307, 308, and 309, respectively. A portion of the first pair of wire tendons 301 is shown in an additional detail view provided as FIG. 3A to particularly illustrate that, although pairs of wire tendons are not visible in FIG. 3, each of the pairs of wire tendons 230 does nevertheless include two distinct wire tendons, which run side-by-side along with one another (that is, the two wire tendons at corresponding positions along their respective lengths are at substantially the same vertical levels, as measured relative to the ground or some similar vertical or substantially vertical reference). Also, in the present embodiment, each of the wire tendons of each pair of the wire tendons is a 7/16 inch diameter wire tendon, although in other embodiments other sizes of wire tendons (e.g., 5/8 inch diameter wire tendons) can be used, with different sizes of wire tendons particularly being selected to provide desired load capacity.

It should be appreciated that pairs of wire tendons in the present embodiment can be considered "paired" particularly in the sense that the support role played by each given tendon of the pair, in terms of supporting other structures upon it (e.g., a particular side edge of a panel section such as one of the panel sections 750 discussed below) is also performed equally or substantially equally by the other wire tendon of the pair, such that the other wire tendon plays a substantially redundant or auxiliary support role relative to the given wire tendon of the pair (and vice-versa). Through the use of pairs of redundant wire tendons, support can still be achieved for the suspended subsystem 130 even in circumstances where one of the wire tendons ceases to provide its intended support role.

Further with respect to the pairing of wire tendons, it should be noted that the mere presence of two wire tendons in support roles in a given suspended subsystem does not necessarily make those two wire tendons "paired" if the support roles provided by each respective wire tendon fail to be shared or overlap to a significant degree or if the support role being provided by the two wire tendons lacks any substantial qualitative similarity. For example, it would be appropriate to consider two wire tendons to be paired if both of the wire tendons support at least one component in the same or a substantially same manner (e.g., where each of two wire tendons supports the same edge of a panel section such as one of the panel sections 750 discussed below). This could be true even if the two wire tendons do not provide equal amounts of support (e.g., where one of the tendons bears 60% of the burden and the other bears 40% of the burden). Alternatively, also for example, it would not be appropriate to consider two wire tendons to be paired in a circumstance where a given one of the wire tendons supported a first side edge of a panel section but the other wire tendon supported a second opposite side edge of that panel section, and where the wire tendons otherwise did not share or substantially share any other support role (e.g., share some other support role with respect to some other component).

Notwithstanding the above description, it should be understood that the present disclosure is also intended to encompass numerous other embodiments employing numerous other arrangements of wire tendons. For example, in some alternate embodiments, the wire tendons of a given pair need not be arranged side-by-side (need not share common vertical levels along their lengths) but rather can be arranged above or below one another or in some other manner. Also for example, in some other embodiments, instead of employing pairs of wire tendons, single wire tendons can be employed independently (that is, employed to perform a support role that is not shared or substantially shared by any other redundant wire tendon or tendons), or groups of more than two wire tendons that are paired with one another (that is, paired in the sense described above, in terms of a shared or substantially shared support role) can be employed. Also, depending upon the embodiment, a given arrangement of paired (or independent) wire tendons can be employed repeatedly throughout the suspended subsystem in a consistent manner, as is the case with the partly implemented suspended subsystem 120 of FIG. 3, or alternatively differing numbers of paired (or independent) wire tendons can be employed in a varying manner at different locations in a given suspended subsystem.

As for the first portion 132 of the support subsystem 130, FIG. 3 particularly shows that first portion of the support subsystem 130 with floor panels and suspension chains removed so as to more clearly reveal several structural support components of that first portion 132 that together form a "skeleton" of that first portion. Such floor panels (upon which work personnel and/or tools or machinery or other items can be supported and move or be moved) and suspension chains (which assist in supporting the first portion 132 relative to the suspension bridge 100) are shown elsewhere in FIGS. 2, 7, and 12, with FIG. 7 particularly illustrating the floor panels. That said, as shown in FIG. 3, in the present embodiment the structural support components (that is, the "skeleton") of the first portion 132 of the support subsystem 130 particularly include a plurality of anchors 300, a plurality of hubs 310, and a plurality of joists 330, where the hubs 310 are connected with one another by way of the joists 330. It will be appreciated from FIG. 3 that the anchors 300 particularly to anchor or support the remainder of the support subsystem 130 in relation to the tower 140, where there is a respective anchor positioned respectively between the tower 140 and each respective hub 310. The anchors 300 can take a variety of forms including, for example, expansion anchors (where bolting to the tower 140 takes place) or chemical anchors (e.g., involving glue).

Figure 4:
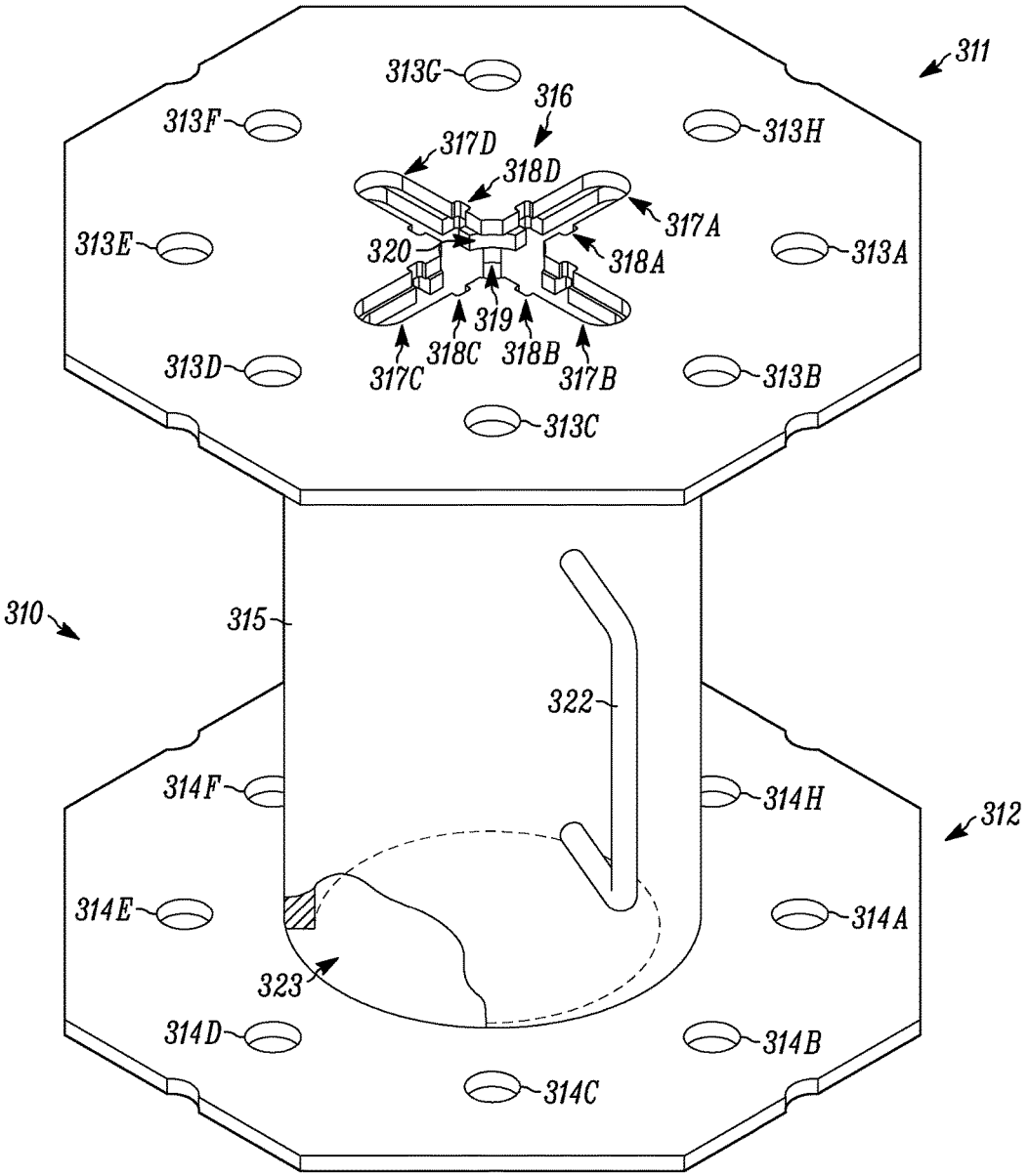
FIG. 4 is a top perspective view of an example hub employed in forming the support subsystem that is shown to be partly implemented in FIGS. 1-3.
Figure 5:
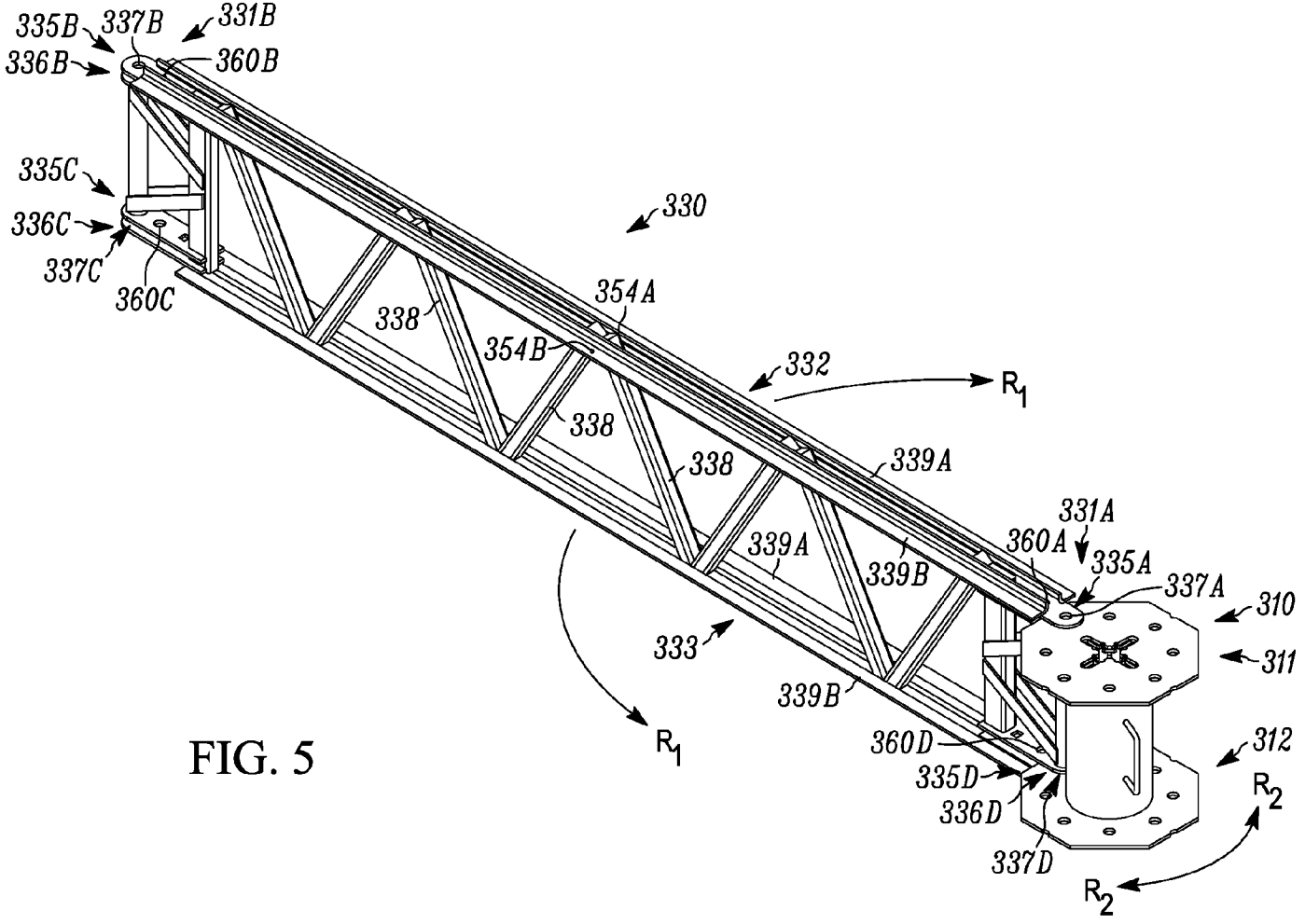
FIG. 5 is a top perspective view of an example joist employed in forming the support subsystem that is shown to be partly implemented in FIGS. 1-3.

Referring to FIGS. 4 and 5, there is illustrated in more detail an example of one of the hubs 310, as well as one of the hubs 310 in connection with an example of one of the joists 330. A joist such as the joist 330 can be considered any elongate structural member adapted for bearing or supporting a load, such as a bar joist, truss, shaped-steel (i.e., I-beam, C-beam, etc.), or the like. By contrast, a hub such as the hub 310 is an interconnection structure, such as a node, hinge, pivot, post, column, center, shaft, spindle, or the like. In the present example, the hub 310 of FIG. 4 (and, indeed, each of the hubs 310 of FIG. 3) is configured so that, when attached to one of the joists 330 as shown in FIG. 5, the hub 310 is capable of articulation relative to the joist 330 (and vice-versa). Articulation, as used herein, is defined as the capability to swing, and/or rotate, about a pivot point or axis.

This articulation feature among other things allows for less manpower to readily assemble and disassemble components of the system in, or near, the desired finished position.

Further as shown in FIGS. 4 and 5, the hub 310 includes a top element 311 and a bottom element 312 spaced at distal ends of a middle section 315. The top element 311 and bottom element 312 can be substantially planar in configuration, as well as parallel to each other. The top element 311 and bottom element 312, in the embodiment shown, are substantially planar surfaces that are octagonal in shape (as viewed from a plan view). The middle section 315 can be a cylindrical section where a longitudinal axis of the middle section 315 is normal to the planes of the top element 311 and bottom element 312. In the embodiment shown, the middle section 315 is a right circular cylinder. In FIG. 4, a lower portion of the middle section 315 is removed for clarity (at a location 323) to reveal that the middle section 315 is hollow. Further as shown in FIG. 4, there are a plurality of openings 313, 314 extending through both the top element 311 and bottom element 312, respectively. The plurality of openings 313 (e.g., 313A, 313B, 313C, 313D, 313E, 313F, 313G, 313H) are interspersed on the top element 311 so as to offer various locations for connecting to one or more of the joists 330 (see, e.g., FIG. 5). The plurality of openings 314 (e.g., 314A, 314B, 314C, 314D, 314E, 314F, 314G, 314H) are similarly spaced on the bottom element 312 so that respective pairs of the openings 313 and 314 (e.g., 313A and 314A) are coaxial.

It should particularly be appreciated that, in the present embodiment, the wire tendons 230 of the partly implemented suspended subsystem 120 can also be coupled to the support subsystem 130 by coupling those wire tendons to respective ones of the openings 313 (or 314) of the appropriate ones of the hubs 310. In the present embodiments, these connection locations generally constitute the junction 225 mentioned above in relation to FIG. 2. The actual mechanism by which coupling takes place can vary depending upon the embodiment. For example, in some embodiments, the wire tendons 230 can have looped ends, and then additional loop structures, C-bracket structures, clasping structures, or hook-type components are provided so as to extend through both the respective looped ends of respective ones of the wire tendons 230 and corresponding ones of the openings 313 (or 314) of the hubs 310 so as to achieve attachment. In other embodiments, any of a variety of other connective, clasping, locking, or fastening mechanisms or brackets can be employed to achieve attachment of the wire tendons 230 (and ultimately the fully completed suspended subsystem) to the support subsystem 130 at the junction 225, and such structures can be supplemented by additional structures that facilitate a clean transition between the floor panels of the support subsystem and the corresponding floor panels of the suspended subsystem.

Also as shown, at the center of the top element 311 is a center opening 316, which is configured to be able to receive a linkage or suspension connector by which the hub 310 can be suspended from another structure, such as from a deck 222 (see FIG. 2) of the suspension bridge 100. The center opening 316 can be generally cruciform in configuration with a center opening area 319 and four slots 317 (e.g., 317A, 317B, 317C, 317D) extending therefrom. Transverse to each of the four slots 317A, 317B, 317C, 317D, and interconnected thereto, are also a series of cross slots 318A, 318B, 318C, 318D. For added strength a reinforcing plate 320 is added to the underside of the top element 311, where openings on the reinforcing plate 320 correspond to (and are generally coextensive with) the center opening 316 configuration and all the ancillary openings thereto (e.g., the slots and area 317, 318, 319). A handle 322 is optionally added to a side of the middle section 315. Although not visible in FIGS. 4 and 5, it should be appreciated that an identical (center) opening is formed on the bottom element 312, and the bottom element along its top side can likewise include a reinforcing plate with the same opening. Also not shown, attached to the reinforcing plate along the bottom element 312 and the interior face of the middle section 315 can be a plurality of gussets that provide added support to the hub 310.

Figure 6B:
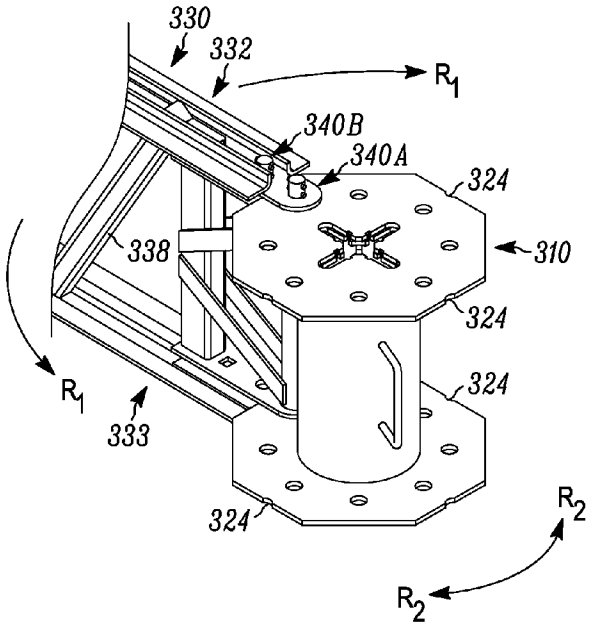
FIGS. 6A and 6B respectively show an exploded top perspective cutaway view and a top perspective cutaway view of an example interconnection between the hub and joist of FIGS. 4 and 5.
Figure 6A:
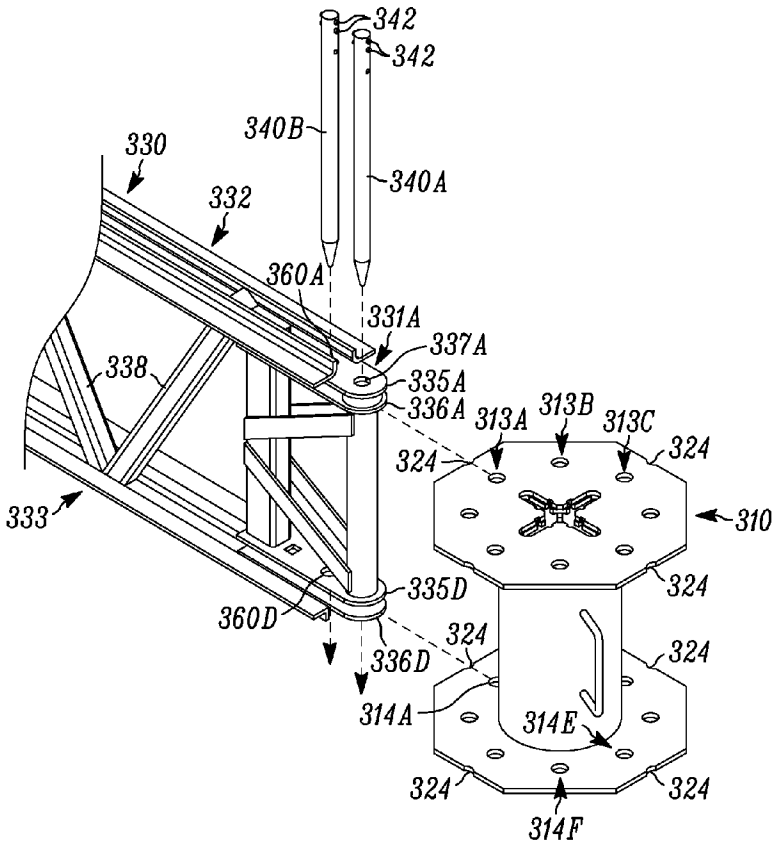

In addition to FIG. 5 depicting a top perspective view of the interconnection between a single one of the hubs 310 and a single one of the joists 330, further FIGS. 6A and 6B show an exploded top perspective cutaway view, and a regular (unexploded) top perspective cutaway view, respectively, of a typical connection between the hub 310 and joist 330. As shown, the joist 330 includes an upper element 332 and a bottom element 333. Interspersed between the elements 332, 333 are a plurality of diagonal support members 338. Each of the elements 332, 333 is made of two L-shaped pieces of angle iron 339A, 339B. The elements 332, 333 typically can be identical in construction, with the exception being that the upper element 332 includes connector holes 354A, 354B at its midspan. The joist 330 includes a first end 331A and a second end 331B. At each of the ends 331A, 331B of both the upper element 332 and bottom element 333, there extends an upper connecting flange 335 and a lower connecting flange 336. Additionally, through each of the upper and lower connecting flanges 335, 336, there are connecting holes 337.

Thus, given the above description, it should be appreciated that there are four upper connecting flanges 335A, 335B, 335C, 335D and four lower connecting flanges 336A, 336B, 336C, 336D, as well as four connecting holes 337A, 337B, 337C, and 337D, on the joist 330. Accordingly, at the first end 331A, extending from the upper element 332, is an upper connecting flange 335A and lower connecting flange 336A, with a connecting hole 337A therethrough (see both FIG. 5 and FIG. 6A). Similarly, at the second end 331B of the upper element 332, there extends an upper connecting flange 335B and lower connecting flange 336B, with a connecting hole 337B therethrough. Also, at the first end 331A of the lower element 333 there extends an upper connecting flange 335D and lower connecting flange 336D. Through these connecting flanges 335D, 336D are a connecting hole 337D. Further at the second end 331B of the joist 330 extending from the lower element 333 is an upper connecting flange 335C and lower connecting flange 336C with a connecting hole 337C therethrough. In addition to the respective connecting holes 337A, 337B, 337C, 337D, each of the connecting flanges 335A, 335B, 335C, and 335D additionally includes a respective additional locking hole 360A, 360B, 360C, 360D, respectively, all of which are located inwardly of the respective connecting holes (that is, axially toward the center of the joist 330 relative to the connecting holes).

Further as shown in FIGS. 6A and 6B, pins 340A can be placed through the connecting holes 337 of the connecting flanges 335, 336 at each of the first end 331A and second end 331B of the joist 330 and further through any two corresponding ones of the openings 313, 314 of the hub 310. FIGS. 6A and 6B particularly show one of the pins 340A employed at the first end 331A, it being understood that the same or substantially same arrangement can be present at the end 331B. In this manner, the joist 330 can be connected in a virtually limitless number of ways, and angles, to the hub 310. For example, as shown particularly in FIGS. 6A and 6B, one of the pins 340A can be placed in through the connecting flange 335A, through the opening 313A, through the connecting flange 336A (all at the first end 331A of the upper element 332), through the connecting flange 335D, through the opening 314A, and then through the connecting flange 336D. In this scenario, the pin 340A further threads through connecting holes 337A and 337D.

Also as shown (particularly see FIGS. 6A and 6B), each of the pins 340A additionally includes two roll pins 342 at its upper end. The lower of the two roll pins 342 acts as a stop, thereby preventing the pin 340A from slipping all the way through the joist 330 and hub 310. The upper roll pin 342 acts as a finger hold to allow easy purchase and removal of the pin 340A from the joist 330 and hub 310. The design of these various parts is such that free rotation of both the joist 330 and hub 310 is allowed, even while the joist 330 and hub 310 are connected together. Rotational arrows $R_1$ of FIGS. 5 and 6B show the rotation of the joist 330 relative to the hub 310, while rotational arrows $R_2$ show the rotation of the hub 310 relative to the joist 330 of FIGS. 5 and 6B. These rotational capabilities of the joist 330 and hub 310 relative to one another provide, in part, the articulating capability of the present design.

Although articulation of the joist 330 and hub 310 relative to one another can occur in some embodiments or operational circumstances, in other embodiments or circumstances such articulation is precluded. In particular, articulation is typically precluded when the work platform system is fully implemented, or even when the structural support components of the partly implemented support subsystem 130 are installed as shown in FIG. 3. To preclude such articulation, as shown in FIGS. 6A and 6B, optional locking pins 340B (one of which is shown) are installed in relation to the interfacing hubs 310 and joists 330. More particularly as shown, locking of the hub 310 and joist 330 of FIGS. 6A and 6B, so as to prevent relative articulation, is achieved by adding the locking pin 340B through the locking holes 360A and 360D proximate the end 331A of the joist 330. The locking pin 340B particularly operates to preclude such articulation (at least in part) due to contact with the hub 310 along two of several grooves (or slots/dimples) 324 formed along the perimeters of the upper element 311 and lower element 312 of the hub 310. Because the locking pin 340B extends through two of the grooves 324, the locking pin effectively is prevented from moving around the perimeters of the upper and lower elements 311, 312 and correspondingly prevents such movement of the joist 330 relative to the hub 310.

As with the pin 340A, the locking pin 340B can include additional two roll pins 342 as shown, which serve the same purposes as discussed above with respect to the roll pins provided on the pin 340A. Although not shown in FIGS. 6A and 6B, it should be likewise understood that another of the locking pins 340B can similarly be added through the locking holes 360B and 360C proximate the end 331B (see FIG. 5) of the joist 330 when that end is connected to another one of the hubs 310 by another of the pins 340A.

It should be appreciated that, in the present embodiment the support subsystem 130 employs components and features according to the QuikDeck™ suspended access system available from Safway Services, LLC of Waukesha, Wis., the beneficial assignee of the present patent application. As already discussed, and as further discussed below, these components of the support subsystem 130 among other things include the anchors 300, hubs 310, and joists 330 and related subcomponents discussed above as well as the floor panels 732 and support chains 220 further discussed below. Nevertheless, it should also be appreciated that a variety of other support subsystems and support subsystem components can also or instead be utilized depending upon the embodiment or circumstance, and such other support subsystems and associated components are also intended to be encompassed herein.

Among other things, the present disclosure is particularly also intended to encompass support subsystems that employ other component(s) such as any of those described in U.S. Pat. No. 7,779,599 entitled "Articulating Work Platform Support System, Work Platform System, and Methods of Use Thereof", issued on Aug. 24, 2010, which is hereby incorporated by reference herein (said issued patent being assigned to a common assignee with the present patent application). Also, for example, notwithstanding the above description of the hubs 310, joists 330, and associated components shown in FIGS. 4, 5, 6A, and 6B, it should be appreciated that these components are only example components that can be employed among the components forming the underlying/internal structural support components (or "skeleton") of the support subsystem 130 and that other structural support components can be employed in other embodiments. Further for example, depending upon the embodiment, the support subsystem 130 can include a variety of other components in addition to, and/or instead of, the anchors, hubs, joists, floor panels, and support chains already discussed above.

Additionally for example, depending upon the embodiment, various differently-shaped components can be utilized. For example, while joists such as the joist 330 can be bar joists, the joists can also be open-web joists and/or structural tubing. Further for example, one or more of the joists 330 can be made of multiple pieces of structural tubing shapes, or the joists 330 can be one single structural tubing shape. Similarly, the joist 330 could be made of shaped steel (e.g., wide flange elements, narrow flange members, etc.), or other suitable shapes and materials. Also, additionally other types of joists that are curved rather than linear (straight) can be employed, as can other types of panel portions and supports for such panel portions. Further, although in the present embodiment it is envisioned that the first and second portions 132 and 134 of the support subsystem 130 (including all hubs, joists, anchors, floor panels, and support chains thereof) will be fully assembled and installed in relation to the towers 140 prior to any portions of the suspended subsystem (e.g., the partly implemented subsystem 120) being implemented, in alternate embodiments it is possible that portions of the support subsystem 130 will be implemented contemporaneously with, or subsequent to, implementation of the suspended subsystem.

Turning now to FIG. 7, a top plan, partly cross-sectional view of an assembly 700 of portions of a further implemented work platform system 710 corresponding to (that is, portions of the system which would be positioned in) the region 150 of FIG. 1 is shown. The particular view provided by FIG. 7 is one taken along line 7-7 of FIG. 12, which as discussed further below shows an additional enlarged detail view of a side elevation view of the assembly 700 in combination with portions of the suspension bridge 100 corresponding to the region 150 of FIG. 1. The further implemented work platform 710 should be understood particularly to be the partly implemented work platform system 110 of FIGS. 1-3 as further modified to include additional components. In particular, the portions of the further implemented work platform system 710 shown in FIG. 7 include both the support subsystem 130 discussed above as well as portions of a further implemented suspended subsystem 720, which is the partly implemented suspended subsystem 120 after being modified to include additional components.

Although the support system 130 appears somewhat different in FIG. 7 by comparison with FIG. 3, this is merely because FIG. 7 now shows panel sections 732 that are supported upon the hubs 310 and joists 330 (the "skeleton") of the support structure that were shown and discussed in relation to FIG. 3. As already mentioned above, the panel sections 732 effectively provide a floor upon which work personnel can walk and on which equipment and components can be transported and supported. Notwithstanding this difference in appearance, it should nevertheless be understood that the support subsystem 130 of FIG. 7 is the same as that shown in FIG. 3, as well as the same as that shown in FIGS. 2 and 12, and thus particularly includes all of the hubs 310, joists 330, and anchors 300 shown in FIG. 3 as well as the panel structures 732 and the support chains 220 shown and discussed in relation to FIGS. 2 and 12. It should additionally be understood that, although the support subsystem 130 is considered be a fully implemented or installed support structure for the present embodiment, in other embodiments additional components not shown in FIG. 7 (or in FIG. 2, 3, or 12), such as railings, can still be added to the support subsystem 130 and that the support subsystem would only be complete after such additional components are implemented.

With respect to the further implemented suspended subsystem 720, as shown in FIG. 3 this suspended subsystem differs from the partly implemented suspended subsystem 120 of FIG. 3 particularly insofar as the subsystem 720 includes multiple panel sections 750 that have been installed so as to be supported upon the various pairs of wire tendons 230. More particularly as shown, given the presence of the nine pairs of wire tendons 230 (that is the pairs of wire tendons 301, 302, 303, 304, 305, 306, 307, 308, and 309), there are shown to be eight partly completed rows of the panel sections 750, namely, first, second, third, fourth, fifth, sixth, seventh, and eighth rows 751, 752, 753, 754, 755, 756, 757, and 758, where each respective one of the rows (e.g., 751, 752, etc.) is supported upon a corresponding pair of successive ones of the pairs of the wire tendons 230 (e.g., the pairs 301 and 302, the pairs 302 and 303, etc.). It should be appreciated that the actual number of rows of panel sections 750, as well as the actual number of pairs of wire tendons 230, can vary depending upon the embodiment. For example, in some other embodiments, there is only a single row of the panel sections 750 positioned on and between two pairs of the wire tendons 230, while in other embodiments, there can be more than or less than eight rows of panel sections and more than or less than nine pairs of wire tendons.

Turning now to FIGS. 8, 9, and 10, a top plan view, side elevation view, and right end side elevation view of an example one of the panel sections 750 of FIG. 3 are respectively shown. For example, FIGS. 8, 9, and 10 can be considered to show a panel section 765 shown in FIG. 3, which is the rightmost panel section of the sixth row 756 of panel sections, and which can be considered identical to each of the other panel sections 750 shown in FIG. 3. As illustrated, the panel section 765 is generally in the shape of an elongated rectangle, and in the present embodiment has a width dimension 759 of 92 inches (or about eight feet) and a length dimension 761 of 24 inches (two feet). For purposes of the present discussion, the width dimension 759 corresponds substantially to the distance between neighboring ones of the pairs of wire tendons, between which the panel section 765 extends, and the length dimension 761 by contrast corresponds to the length of the panel section 765 along the wire tendons (albeit in other embodiments length and width dimensions can be defined differently).

In other embodiments, these dimensions of any one or more of the panel sections that are employed in a given suspended subsystem can vary from those shown with respect to the panel section 765. For example, in another embodiment, the panel section can be approximately eight feet long by one foot wide. Indeed, the panel section need not be an elongated rectangle but also could be another shape, such as that of a square. Additionally, although not shown in FIG. 7, in some embodiments different panel sections having different sizes (and/or shapes) can be implemented in the same work platform system. For example, certain of the panel sections can have the two feet by eight feet dimensions stated above, and others of the panel sections in the same work platform system can have one foot by eight feet dimensions. Through the use of panel sections of varying dimensions (e.g., different length and/or width dimensions), a variety of practical issues associated with the implementation of the work platform system can be conveniently addressed. For example, if one or more obstacles (e.g., a pipe jutting beneath the deck 22) precludes the implementation of one of the panel sections 750 along one of the rows of panel sections, it can still potentially be possible for a panel section of a different size to be implemented instead.

As an example, the panel section 765 particularly includes a top panel surface 763 having dimensions that are equal to the previously-mentioned width and length dimensions 759 and 761 of the overall panel section 765, and that is the surface upon which work personnel can walk. In the present embodiment, the top panel surface 763 is made of wood (e.g., plywood). Use of wood as the top panel surface 763 can be particularly advantageous in that surface provides better traction even during conditions where moisture exists on the surface (e.g., during a rainstorm) than if other materials such as sheet metal were used. Nevertheless, the particular material employed to form the top panel surface 763 can vary depending upon the embodiment.

Further with respect to the panel section 765, the top panel surface 763 is mounted upon steel tubes or struts 760, which are shown in each of FIGS. 8, 9, and 10 (the struts are shown in phantom particularly in FIG. 8), and which a support structure or "skeleton" underlying the panel surface 763. Additionally as shown, the struts 760 particularly include a pair of side struts 762, a pair of end struts 764, and a middle strut 766. The side struts 762 and end struts 764 effectively form a loop that follows along the perimeter of the panel surface 763, with the side struts 762 extending the full length of the width dimension 759 and the end struts 764 extending the full width of the length dimension 761. The middle strut 766 is positioned underneath the panel surface 763 so as to extend between the two side struts 762, midway between the end struts 764.

In addition to the top panel surface 763 and the struts 760, the panel section 765 additionally includes several support components that extend outward from the struts 760 and allow for the mounting of the panel section 765 in relation to the wire tendons 230 and also in relation to other ones of the panel structures 750 as shown in FIG. 7 (e.g., so as to form the rows of panel sections). More particularly as shown, these support components include four wire tendon support extensions 770 as well as four handle support extensions 780, all of which extend outward beyond the confines of either the width and length dimensions 759 and 761 mentioned above. As shown, the wire tendon support extensions 770 particularly extend outward away from the end struts 764, that is, outward along directions that are parallel or substantially parallel to the width dimension 759. Two of the wire tendon support extensions 770 extend outward generally at opposite ends of one of the side struts 762, and the other two of the wire tendon support extensions 770 extend outward generally at opposite ends of the other of the side struts 762. By contrast, the handle support extensions 780 extend outward from the side struts 762 in directions parallel or substantially parallel to the length dimension 761, and are all positioned at locations well inward of the end struts 764.

As is evident from FIG. 8, the wire tendon support extensions 770 include small bends 774 such that outer portions 776 of the extensions 770 are shifted slightly relative to inner portions 778 by which the extensions 770 are affixed to the end struts 764. More particularly, in the present embodiment, each of the wire tendon support extensions 770 extending from a first one of the end struts 764 (e.g., the right end strut shown in FIG. 8) has a respective outer portion 776 that is offset or shifted in a first direction along the length dimension 761, and each of the wire tendon support extensions 770 extending from the other one of the end struts 764 (e.g., the left end strut shown in FIG. 8) has a respective outer portion 776 that is offset or shifted in a direction opposite that of the first direction. Such oppositely-directed offsets (or "joggles") of the outer portions 776 that are at opposite ends of the panel section 765 are complementary so as to make it possible for two of the panel sections 750 in neighboring ones of the rows (e.g., two panel sections that are respectively positioned, side by side, in the rows 756 and 757 of FIG. 7) to be supported upon a shared pair of the wire tendons 230 (e.g., by the pair of wire tendons 307) and also to be aligned such that the corresponding side struts 762 of each of the panels sections are exactly aligned with one another. Thus, in FIG. 7, the rows 751, 752, 753, 754, 755, 756, 757, and 758 of the panel sections 750 are shown to be completely aligned with one another.

Further as illustrated, particularly in FIG. 9, each of the wire tendon support extensions 770 and particularly the outer portions 776 thereof includes a pair of indentations 772 that extend upward from a bottom ridge of those portions. It is by virtue of these indentations 772 that the outer portions 776 of the wire tendon support extensions 770 can be slipped over and onto the two pairs of wire tendons 230 between which the panel 750 is to be positioned. Thus, for example, continuing to assume that the panel section 750 of FIGS. 8, 9, and 10 is the panel section 765 of FIG. 7 that is the rightmost one of the panel sections of the sixth row of panel sections 756, then the indentations 772 of the leftward one of the outer portions 776 shown in FIG. 9 can be considered to be the indentations that receive (slip over) the pair of wire tendons 307, and the indentations 772 of the rightward one of the outer portions 776 shown in FIG. 9 can be considered to be the indentations that receive (slip over) the pair of wire tendons 306.

In addition to the above features, it will be observed from FIG. 9 that in the present embodiment each of the wire tendon support extensions 770 also includes an orifice or notch 781, positioned generally in between the indentations 772 of the respective wire tendon support extension. By virtue of the presence of the orifices 781 of the wire tendon support extensions, in some embodiments, additional structures such as guard rail posts or wires or other structures (not shown) can be affixed to the wire tendon support extensions and thus to the remainder of the suspended subsystem.

Notwithstanding the above discussion concerning the wire tendon support extensions 770, it should be appreciated that those extensions (or similar structures employed to allow the panel sections 750 to be supported upon flexible support elements such as the wire tendons 230) can take on different forms in other embodiments. For example, in some alternate embodiments, the wire tendon support extensions do not have any offsets (or "joggles"). That is, in such embodiments, the wire tendon support extensions are straight such that the inner and outer ends (that is, the portions of the wire tendon support extension corresponding to the inner and outer portions 778 and 776 discussed above) are aligned. The offsets (or "joggles") need not be employed in all embodiments, since the thickness of the wire tendon support extensions can be small, and since there is not always any particular need that panel sections provided in rows on opposite sides of a given pair of wire tendons be fully aligned (that is, so that the side struts 762 of panel sections in different rows are lined up).

Further in some alternate embodiments one or more subfeatures of one or more the wire tendon support extensions can take a form different than those discussed above with respect to FIGS. 8, 9, and 10. For example, in one alternate embodiment, one or more of the wire tendons support extensions of a panel section can take the form of a wire tendon support extension 770A shown in FIG. 9A, which for comparison purposes is shown to correspond to a portion of one of the wire tendon support extensions 770 of FIG. 9. In this example, rather than having the two indentations 772 that are identical in shape, instead the wire tendon support extension 770A has a first indentation 772A and a second indentation 772B that are somewhat different in shape, with the second indentation 772B identical or substantially identical to the indentations 772 of FIG. 9 but the first indentation 772A having an additional cutout region 783A expanding the indentation beyond the size and shape of the indentations 772 of FIG. 9. The expanded size of the first indentation 772A with the additional cutout region 783A allows, in at least some embodiments, easier mounting of the wire tendon support extension 770A onto pairs of wire tendons such as the wire tendons 230. Also it can be noted that, in the alternate embodiment of FIG. 9A, the wire tendon support extension 770A includes an orifice 781A corresponding to the orifice 781 of one of the wire tendon support extensions 770 of FIG. 9 except insofar as the orifice 781A is positioned lower and closer to the second indentation 772B than to the first indentation 772A (at least when compared to the uppermost tips of the two indentations) to accommodate the presence of the additional cutout region 783A of the first indentation 772A. Notwithstanding the above description concerning FIGS. 9 and 9A, it should be understood that the wire tendon support extensions can be modified in other manners as well. For example, in some additional embodiments, additional holes (e.g. in addition to the orifice 781 or orifice 781A can be added to facilitate fixturing and/or for use on scaffold arrangements of other sizes).

Referring still to FIGS. 8, 9, and 10, the handle support extensions 780 take a different structural form than the wire tendon support extensions 770 insofar as each of the extensions 780 is a looping structure that extends outward away from one of the side struts 762 (outward away from the top panel surface 763), then extends sideways generally parallel to the side struts so as to form a respective intermediate handle portion 779, and then loops back so as to connect up again with the respective side strut from which it originally extended (at a different location along that side strut). In this sense, each of the handle support extensions 780 is a U-shaped extension. Further as evident from FIG. 10, when the panel section 765 is viewed from the right end side (or the left end side), it becomes apparent that each of the handle support extensions 780 not only is U-shaped but also has an L-shaped characteristic. More particularly as shown, each of the handle support extensions 780 juts outward from the respective side strut 762 on which it is mounted, in a generally horizontal manner (that is, parallel to the top panel surface 763), but then extends further to include a hook-like formation 785, at which the respective handle support extension first dips down (that is, away from the top panel surface) slightly and then curves back upward (that is, toward the plane of the top panel surface) to a location at which the intermediate handle portion 779 of the extension is formed. In the present embodiment, the respective intermediate handle portions 779 of the respective handle support extensions 780 are at respective locations that are substantially higher than the respective locations at which the respective handle support extension 780 first extend horizontally outward.

The particular hook-shaped configuration of the handle support extensions 780 of each of the panel sections 750 such as the panel section 765 serves several purposes. To begin, shape of the handle support extensions 780 allows those extensions to serve as handles by which work personnel (or other installation equipment) can grasp and support (and thus lift and move) the panel sections 750 during implementation of the work platform system. Additionally, the shape and positioning of the handle support extensions 780 (as discussed further below) allows for adjoining ones of the panel sections 750 in any given row of the panel sections to be easily positioned in relation to one another and ultimately interlocked with one another. Indeed, due to this interlocking of panel section sections of a given row afforded by the handle support extensions 780, in combination with the weight of the panel sections themselves, the panel sections 750 in the present embodiment can generally be supported and mounted onto the pairs of wire tendons 230 (with the indentations 772 receiving the pairs of wire tendons) without any additional securing mechanisms that would tend to preclude lifting of the panel sections off of the wire tendons. That is, the panel sections 750, once in place, are not positively locked to the wire tendons but merely remain in place relative to those tendons because of their weight and their interconnections with neighboring panel sections. That said, it should also be appreciated that, in alternate embodiments, the panel sections 750 can include other features by which the panel sections are positively locked or secured to the pairs of wire tendons on which those panel sections are supported.

Figure 11A:
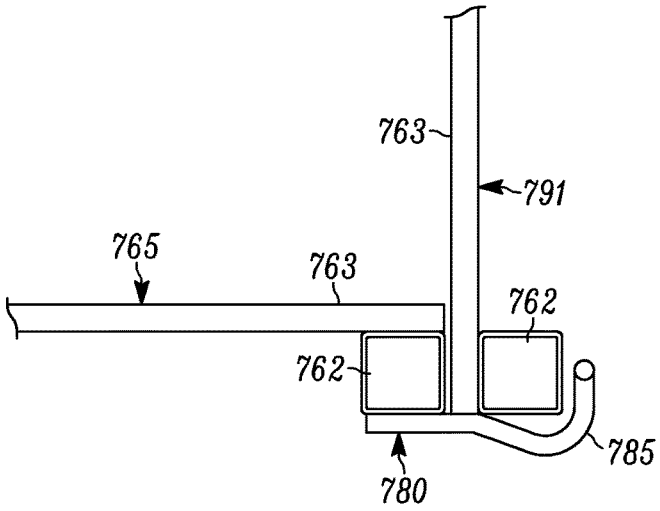
FIGS. 11A, 11B, and 11C respectively show first, second, and third partially cutaway schematic views of the example panel section of FIGS. 8-10 along with an additional panel section of the same type in three different arrangements, respectively, so as to illustrate how panel sections of a given row of panel sections can be implemented in relation to one another.
Figure 11B:
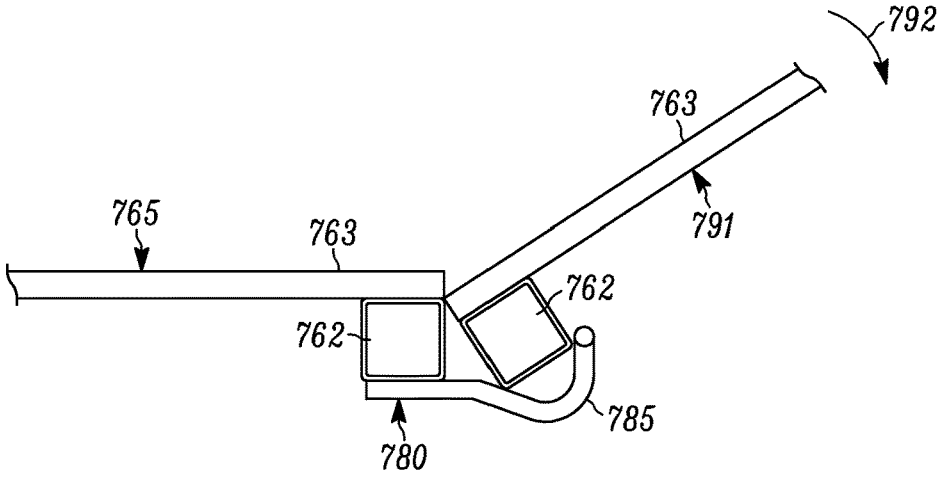
Figure 11C:
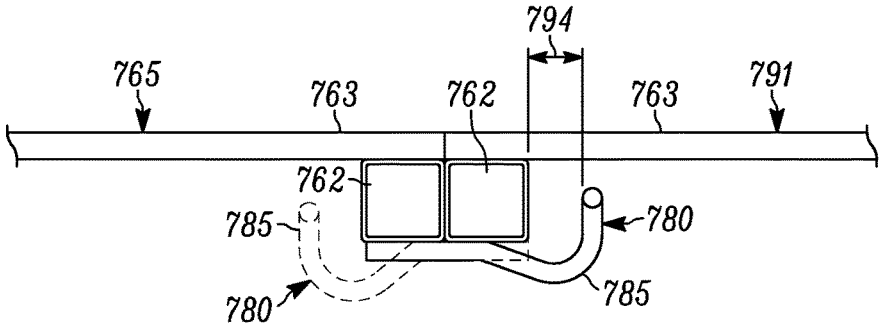

Further in regard to the installation and interlocking of the panel sections 750 such as the panel section 765, FIGS. 11A, 11B, and 11C respectively provide first, second, and third partially cutaway schematic views of an additional panel section 791 (which is of the same type as each of the panel sections 750) being installed in relation to the panel section 765 that has already been positioned onto the wire tendons 230 (e.g., on to the sixth and seventh pairs 306 and 307 of the wire tendons), so that the additional panel section 791 likewise is positioned onto and supported by those wire tendons. More particularly, each of FIGS. 11A, 11B, and 11C is a cross-sectional view that is taken through both of the panel sections 765 and 791, along a line that corresponds to a line 11-11 shown in FIG. 8 with respect to the panel section 765, where as shown in FIG. 8 the line 11-11 cuts through one of the handle support extensions 780 of the panel section 765 that is along that one of the side struts 762 of that panel section adjacent to which the additional panel structure 791 is to be placed. Further in this regard, it should be understood that, although FIG. 8 does not show also the additional panel section 791, the cross-sectional view that is provided in FIGS. 11A, 11B, and 11C is that which would be appropriate given a typical installation process of the additional panel section 791 in relation to the panel section 765 in which the end struts 764 of the two panel sections are aligned with one another.

More particularly, FIG. 11A shows how, when the additional panel section 791 is first being installed in relation to the panel section 765, the additional panel section 791 is first positioned (e.g., by work personnel lifting the panel section 791 into place using the handle support extensions 780) so that the top panel surface 763 of the additional panel section 791 is received into and extends substantially vertically upward from the two co-aligned handle support sections 780 of the panel section 765. When positioned in this manner, a first of the side struts 762 of the additional panel section 791 is positioned into the hook formations 785 of the handle support extensions 780 of the first panel section 765 into which the additional panel section 791 has been received. Also, in this initial position, the top panel surface 763 extends downward to the handle support extensions 780 of the panel section 765 (or almost to those handle support extensions) and extends in between the neighboring side struts 762 of the panel sections 765 and 791).

Turning to FIGS. 11B and 11C, respectively, upon the additional panel section 791 being positioned into place relative to the panel section 765 as shown in FIG. 11A, then further installation of the additional panel section 791 occurs by rotation of that panel section 791 in a direction generally indicated by an arrow 792 of FIG. 11B, that is, rotation generally downward and outward away from the panel section 765, up until such time as the additional panel section 791 is fully in place such that the top panel surface 763 of that panel section is horizontal and parallel to the top panel surface 763 of the panel section 765. When such rotational movement is fully completed, it will be appreciated that both of panel sections 765 and 791 are then supported upon the wire tendons 306 and 307 between which those panels both extend, by way of the wire tendon support extensions 770 formed on each of those panels (as discussed above with respect to FIGS. 8 and 9). Also, upon full installation, the neighboring side struts 762 of the panel sections 765 and 791 generally adjoin one another. It will be appreciated that, to allow for proper rotation of the additional panel section 791 relative to the panel section 765, the handle support extensions 780 necessarily extend outward away from the side strut 762 of the first panel section 765 on which those handle support extensions are mounted by a distance that is somewhat in excess of the cross-sectional width of the side struts 762 of the additional panel section 791, with such an excess distance being shown in FIG. 11C as a distance 794.

Further as shown in FIG. 11C (although not shown in FIGS. 11A and 11B), the additional panel section 791 includes handle support extensions 780 just as does the panel section 765. Given that the spacing of the handle support extensions 780 on each of the panel sections 765, 791 is the same as that shown in FIG. 8 (which is representative of the features of each of the panel sections 750 including the panel sections 765 and 791), it should be recognized that the handle support extensions 780 on one of the side struts 762 of each of the panel sections 750 are offset in a first direction, relative to the middle strut 766 of the respective panel section, but that the handle support extensions 780 on the opposite one of the side struts 762 of the respective panel section 750 are offset from the middle strut in the opposite direction. That is, the handle support extensions 780 along the top one of the side struts 762 as shown in FIG. 8 are offset to the right while the handle sections along the bottom one of the side struts 762 are offset to the left. More particularly, in the present example embodiment of the panel section 765 as shown in FIG. 8, the leftmost portion of the left handle support extension 780 extending from the upper one of the side struts 762 is offset thirty-two inches from the left side edge of that panel section, which is also the left side edge of the left one of the end struts 764, and the leftmost portion of the right handle support extension 780 extending from that side strut is offset over another twenty-eight inches from the leftmost portion of that left handle support extension. By contrast, the rightmost portion of the right handle support extension 780 extending from the lower one of the side struts 762 is offset thirty-two inches from the right side edge of that panel section, which is also the right side edge of the right one of the end struts 764, and the rightmost portion of the left handle support extension extending from that side strut is offset over another twenty-eight inches from the rightmost portion of that right handle support extension.

Given this arrangement of the handle support extensions 780 on each of the panel sections 750, it should be appreciated that the handle support extensions 780 of each of the panel sections 750 are substantially complementary. That is, due to the oppositely-shifted arrangements of the handle support extensions 780 on opposite sides of each of the panel sections 750, neighboring panel sections can be positioned next to one another in a manner in which, instead of the handle support extensions 780 of the neighboring panel sections encountering and obstructing one another, the handle support extensions 780 of each of the neighboring panel structures serves to engage or mesh with the other of the neighboring panel structures. For example, when one of the panel sections 750 such as the additional panel section 791 is implemented in relation to another of the panel sections such as the panel section 765 as shown in FIG. 11C, the handle support extensions 780 on the side of the panel section 765 facing the additional panel section 791 extend under and up and around the adjoining side strut 762 of the additional panel section 791, and likewise the handle support extensions 780 on the side of the panel section 791 facing the panel section 765 (as shown in phantom in FIG. 11C) extend under and up and around the adjoining side strut 762 of the panel section 765.

Although the panel section 765 shown in FIGS. 8, 9, and 10 and again in FIGS. 11A, 11B, and 11C is one example type of panel section that can be employed in a suspended subsystem such as the further implemented suspended subsystem 720, as already discussed it should be appreciated that depending upon the embodiment or circumstance numerous types of panel sections having many different types of features can be employed. In addition to variations in the overall sizes, dimensions, or shapes of the panel sections that are employed, which can vary with the particular suspended subsystem and even vary in the context of a given suspended subsystem, it is also possible for features of the panel sections such as the handle support extensions to vary as well. FIGS. 11D, 11E, 11F, 11G, 11H, 11I, 11J, 11K, 11L, and 11M are several examples of alternative panel sections 850, 856, 860, 870, 880, 885, 888, and 890 having certain features differing from those of the panel section 765. More particularly, as shown, in these example embodiments, each of the alternative panel sections includes wire tendon support extensions 770 substantially identical to those of the panel section 756, but instead have different types or arrangements of handle support extensions and/or complementary components for interfacing handle support extensions.

Figure 11D:
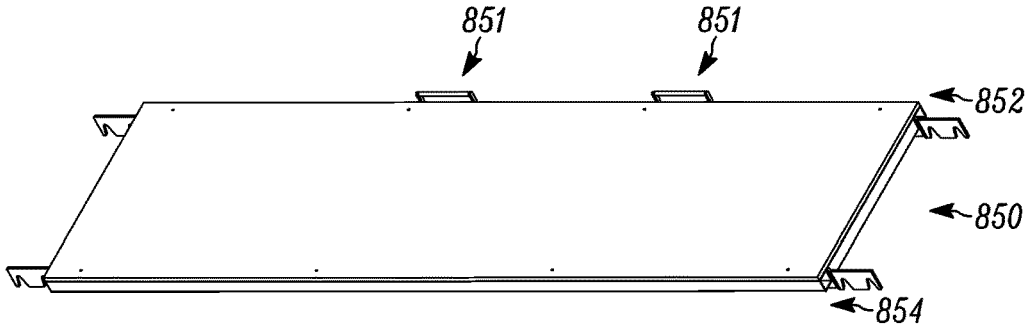
FIGS. 11D, 11E, 11F, and 11J show perspective views of alternative panel sections having features differing from the panel section of FIGS. 8-10.

More particularly in this regard, referring to FIG. 11D, a perspective view is provided of the alternative panel section 850, which is substantially identical to the panel section 765 except insofar as, although the alternative panel section 850 includes a pair of the handle support extensions extending from a first side 852 of the alternative panel section, no other handle support extensions are provided on the opposite side 854 of the alternative panel section. Additionally, rather than employing the hooked type of handle support extensions 780 present in the panel section 756, the alternative panel section 850 employs handle support extensions 851 that differ from the handle support extensions in that the handle support extensions merely extend outward from the side 852 horizontally and then experience an upward 90 degree bend, as is shown particularly well in FIG. 11G, which is discussed further below.

Figure 11E:
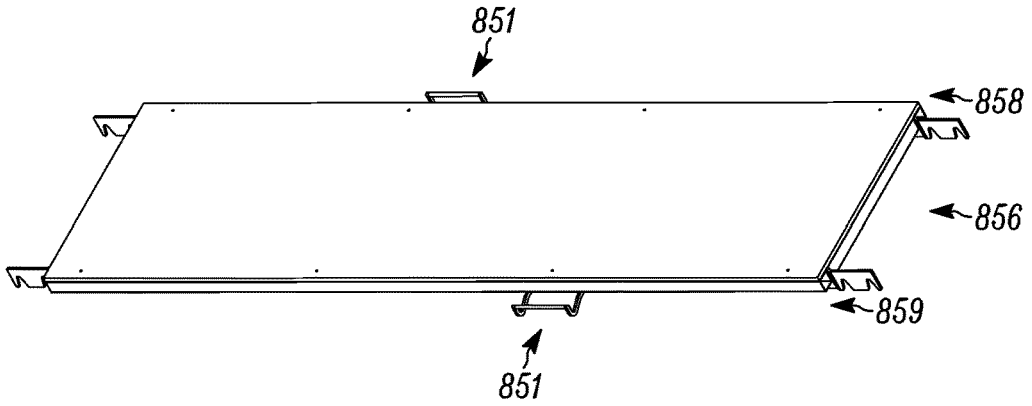
Figure 11F:
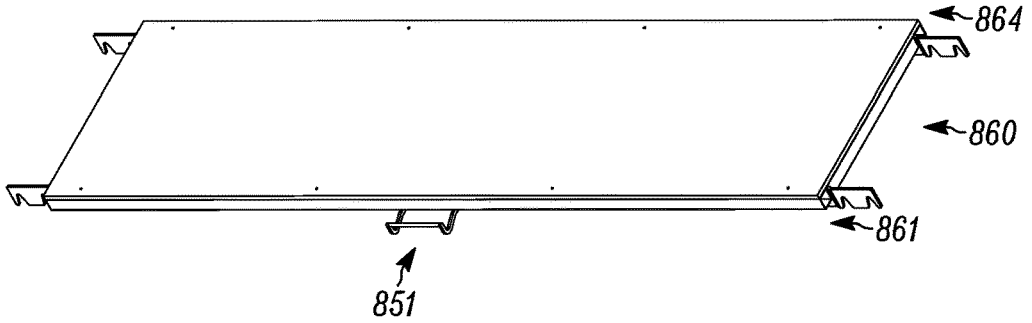

Further, referring to FIG. 11E, a perspective view is provided of the alternative panel section 856, which is substantially identical to the alternative panel section 850 except insofar as, although the alternative panel section 856 includes a pair of the handle support extensions 851, one (rather than two) of those handle support extensions is provided on a first side 858 of that alternative panel section and the other of those handle support extensions is provided on an opposite side 859 of that alternative panel section. Additionally, referring to FIG. 11F, a perspective view is provided of the alternative panel section 860, which is substantially identical to the alternative panel section 856 except insofar as the alternative panel section 860 only includes a single one of the handle support extensions 851 along a first side 861 (positioned generally at the middle of that side), but no handle support extension along an opposite side 864.

Figure 11G:
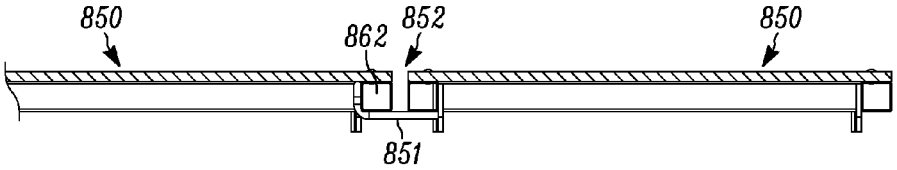
FIGS. 11G and 11I respectively show cross-sectional, partly cutaway and side elevation views of two pairs of two alternative panel sections differing from the panel section of FIGS. 8-10.

Although the type, number, and positioning of the handle support extension(s) 851 in each of the alternative panel sections 850, 856, and 860 varies from that of the panel section 756, it should be appreciated that the handle support extension(s) in each of these alternative panel sections still can perform to at least some extent the functions performed by the handle support extensions 780 in the panel section 756 (and the panel section 790) as illustrated in FIGS. 11A, 11B, and 11C. The handle support extension(s) 851 can still be used for carrying and moving of the alternative panel sections 850, 856, and 860. Also, the handle support extension(s) 851 can further serve (at least to some extent) to orient, capture and support adjacent panel sections. For example, as illustrated in FIG. 11G, which illustrates in a cross-sectional, partly cutaway view two of the alternative panel sections 850 of FIG. 11D in an assembled positioned adjacent to one another side-by-side (as if in a row of the panel sections), it is still the case in such an embodiment that the handle support extensions 851 extending from the opposite side 852 of one of those alternative panel sections will extend under, up, and around a neighboring side strut 862 of the other of those alternative panel sections 860, and thus serve to at least partly hold in place and support that other panel section.

Figure 11H:
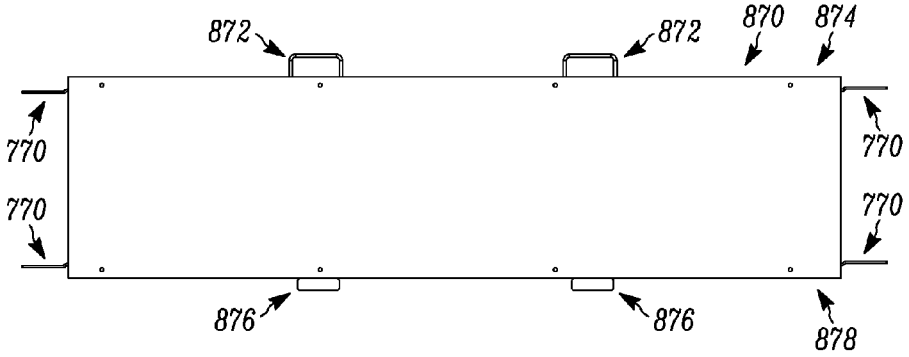
FIGS. 11H, 11K, 11L, and 11M show top plan views of alternative panel sections having features differing from the panel section of FIGS. 8-10.

Further, with respect to FIG. 11H, the alternative panel section 870 by contrast with the alternative panel section 850 of FIG. 11D includes a pair of handle support extensions 872 extending from a first side 874 that, in contrast to the handle support extensions 851, have no bends at all but rather merely are U-shaped structures extending out purely horizontally from the first side 874. Additionally, on an opposite side 878 of the alternative panel section 850, rather than having any handle support extensions of any type, instead that alternative panel section includes a pair of complementary interlocking devices or protrusions 876. As shown, each of the respective interlocking devices 876 is aligned, along the opposite side 878, with a respective one of the handle support extension 872 positioned on the first side 874, and the interlocking devices 876 are sized and configured so that protruding portions of the interlocking devices will respectively fit within complementary interior orifice regions of the handle support extensions 872 of another one of the alternative panel sections 870 when two such alternative panel sections are assembled.

Figure 11I:
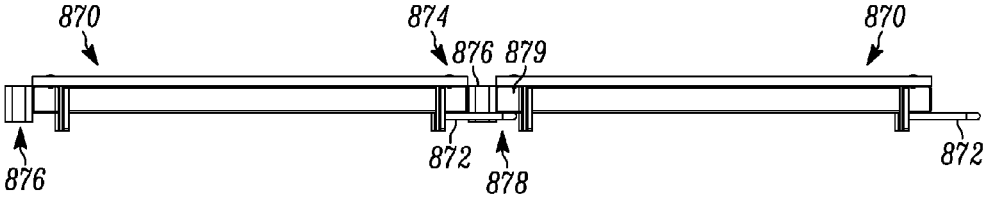
Figure 11J:
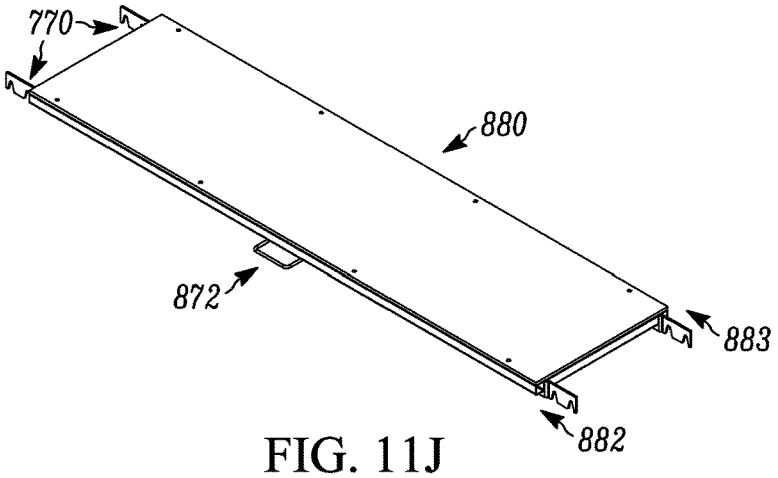

Such an arrangement is shown in FIG. 11I, which provides a side elevation view of two of the alternative panel sections 870 of FIG. 11I positioned adjacent to one another side-by-side (as if in a row of the panel sections). As illustrated, the interlocking devices 876 along the opposite side 878 of one of the alternative panel sections 870 are received within, and extend through and beneath, respective ones of the handle support extensions 872 positioned on the first side 874 of another of the alternative panel sections. Given such positioning of the interlocking devices 876 within the handle support extensions 872, the two alternative panel sections 870 are interconnected with one another. Further, as with the handle support extensions 780 and 851, the handle support extensions 872 again serve both as handles to facilitate carrying and moving of the alternative panel sections 870, but also serve to support the adjacent alternative panel section. For example, as illustrated in FIG. 11I, the handle support extensions 872 receiving the interlocking devices 876 also extend beneath a neighboring side strut 879 of the alternative panel section associated with those interlocking devices.

Figure 11K:
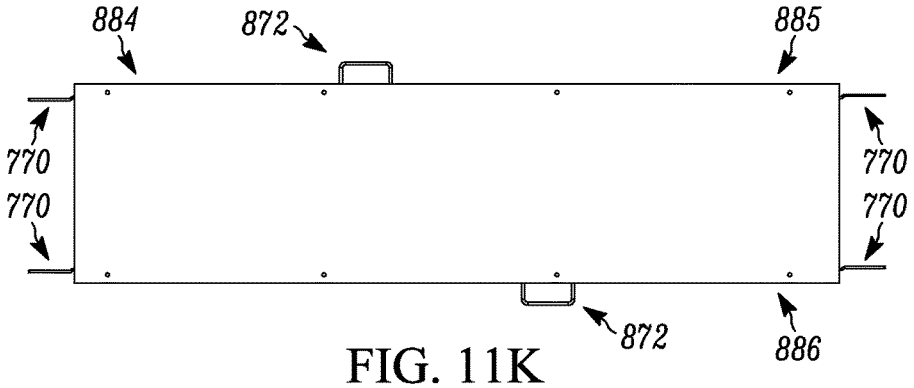
Figure 11L:
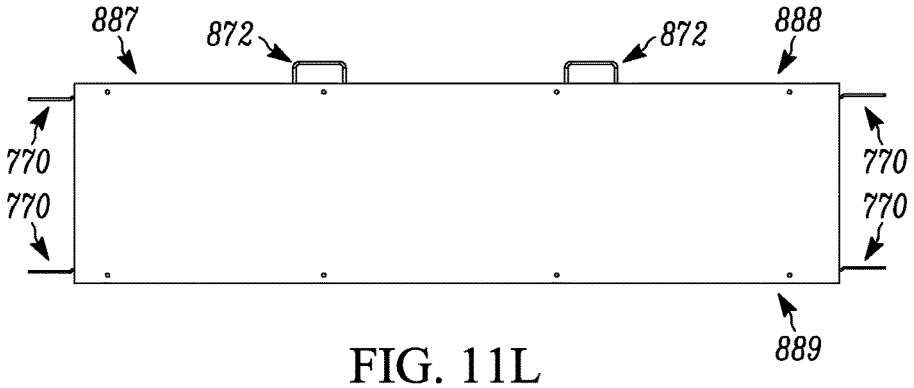
Figure 11M:
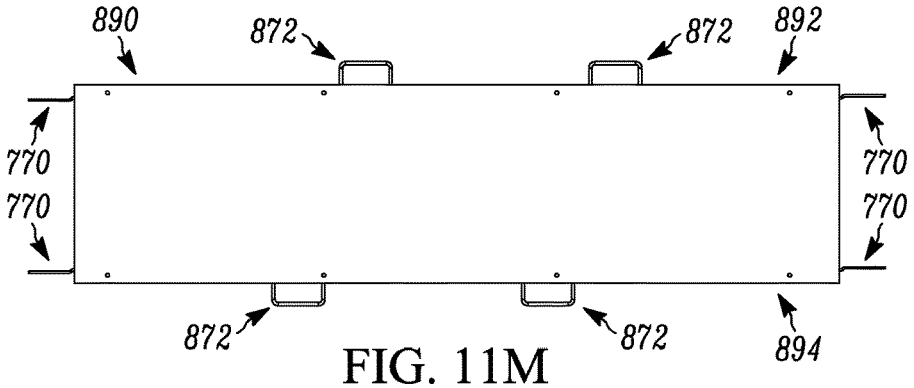

Although the alternative panel section 870 shown in FIGS. 11H and 11I is one example of an alternative panel section employing the handle support extensions 872 that are flat, the alternative panel sections 880, 885, 888, and 892 respectively shown in respective FIGS. 11J, 11K, 11L, and 11M are additional examples in this regard. In contrast to the alternative panel section 870, however, none of the alternative panel sections 880, 885, 888, and 892 include any of the interlocking devices 876. More particularly, FIG. 11H shows a perspective view of the alternative panel section 880, and shows that panel section as having only one of the handle support extensions 872 extending from a first side 882 (generally from a middle location along that side) but having no other handle support extension 872 extending from an opposite side 883. By contrast, FIG. 11K shows the alternative panel section 885 as having one of the handle support extensions 872 extending from a first side 885 and another of the handle support extensions 872 extending from an opposite side 886, FIG. 11L shows the alternative panel section 888 as having two of the handle support extensions 872 extending from a first side 887 but no handle support extensions extending from an opposite side 889, and FIG. 11M shows the alternative panel section 894 as having two of the handle support extensions 872 extending from a first side 892 and another two of the handle support extensions 872 extending from an opposite side 894.

It should be appreciated that, as with the handle support extensions 780 of the panel section 756, the pairs of the handle support extensions 872 extending from the first and opposite sides 892 and 894 of the alternative panel section 890 of FIG. 11M are offset from one another along the lengths of those respective sides, so as to be complementarily positioned to facilitate the positioning of multiple ones of the alternative panel sections 890 side-by-side. Likewise, as with the handle support extensions 851 of the alternative panel section 856 of FIG. 11E, the handle support extensions 872 of the alternative panel section 885 of FIG. 11K are offset from one another along the lengths of the sides 884 and 886 so that the handle support extensions on the opposite sides are positioned complementarily. Additionally, it should be appreciated that the examples of alternative panel sections discussed above are merely examples and that numerous other variations of panel sections can be implemented in embodiments encompassed by the present disclosure.

Returning to FIG. 7 and further turning to FIGS. 7A and 7B, full implementation of the suspended subsystem includes not only implementing the panel sections 750 onto the wire tendons 230, but also involves implementation of additional components as well. To illustrate these additional components, FIG. 7A provides a detail view of a region 961 of FIG. 7 particularly focused upon a location at which several of the panel sections 750 of each of two neighboring rows of the panel sections 751 and 752 are supported upon an intermediate pair of the wire tendons 230, namely, the wire tendons 302. Further, FIG. 7B is also provided to show the same region (region 961) as shown in FIG. 7A, as that region would be seen from underneath (that is, FIG. 7A is a top plan view of the region 961 while FIG. 7B is a bottom plan view of that region or substantially the same region).

From FIGS. 7A and 7B, it should particularly be evident that, due to the configuration of the panel sections 750 and the wire tendon support extensions 770, the top panel surfaces 763 of the panel sections do not cover over the supporting wire tendons 302, but rather there is a space or gap between the top panel surfaces of the panel sections 750 of neighboring rows of the panel sections such as the rows 751 and 752. Given the presence of these gaps between the top panel surfaces 763 of neighboring rows of the panel sections 750 such as the panel sections of the rows 751 and 752, in the present embodiment additional cover structures (or deck retainers) 767 are provided subsequent to the implementation of the panel sections onto the wire tendons 230, with one of the additional cover structures 767 particularly being shown in FIGS. 7A and 7B. The additional cover sections 767 serve to fill in the gaps between the top panel surfaces 763 of the panel sections 750 of neighboring rows of the panel sections (again, such as the rows 751 and 752) and to cover over the pairs of wire tendons 230 therebetween (e.g., the pair of wire tendons 302) along generally the entire lengths of those wire tendons except for locations at which suspension chains are coupled to the wire tendons by way of suspender clamps discussed further below.

In addition to this function of bridging the gaps between rows of panel sections, in the present embodiment the additional cover sections 767 also serve to retain the panel sections 750 in position relative to the pairs of wire tendons 230. This is possible because, as illustrated particularly in FIGS. 7A and 7B, the additional cover sections have widths that are greater than the gaps between the rows of panel sections such that outer edges 899 of the additional cover sections actually extend over edge portions of the panel sections (FIG. 7B shows the outer edges 899 in phantom). Additionally, as illustrated in FIGS. 7A, 7B, as well as FIGS. 17A, 17B, 17C, 17D, 18, 19, and 20 discussed further below, the additional cover sections 767 in the present embodiment are themselves coupled tightly to the wire tendons 230 by way of additional components.

Figure 18:
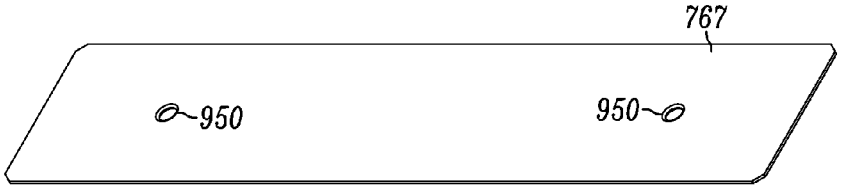
FIG. 18 is a perspective view of an example additional cover structure (or deck retainer)

More particularly, in the present embodiment, the additional cover sections 767 includes a pair of bolt holes 950 by which the additional cover sections 767 can be bolted to a pair of deck retainer clamps (or rotating cable clamps) 769. FIG. 18 shows a perspective view of one of the additional cover sections 767 and particularly shows the bolt holes 950. FIGS. 17A, 17B, 17C, and 17D, respectively, show a perspective side view, top plan view, side elevation view, and end elevation view of an example one of the deck retainer clamps 769. As shown, the deck retainer clamp 769 includes a main outer shell 952 having a roof 954 and first and second side walls 956 and 957 respectively extending downwards from each of two sides of the roof, respectively. Also, the deck retainer clamp 769 includes a flat internal compression structure 958 that includes two ear extensions 960 that respectively fit into two complementary slots 962 formed near the bottom edges of each of the two side walls 956, 957. Although generally complementary, the complementary slots 962 are slightly larger than the ear extensions 960, particularly in a vertical direction. Consequently, when the flat internal compression structure 958 is positioned within an internal channel 964 between the side walls 956 and 957 of the main outer shell 952 such that the ear extensions 960 extend within the complementary slots 962, the flat internal compression structure 958 can move vertically upward and downward relative to the main outer shell 952.

In addition to the above-mentioned features, the first side wall 956 of the main outer shell 952 has first and second wire receiving indentations 966 and 967, respectively, and the second side wall 957 has third and fourth wire receiving indentations 968 and 969, respectively. As shown, all of the wire receiving indentations 966, 967, 968, and 969 are generally located at a vertical level that is substantially the same, but slightly higher, than the complementary slots. Also, the first and second wire receiving indentations 966 and 967 are located respectively at generally opposite ends of the first side wall 956, and the third and fourth wire receiving indentations 968 and 969 are located respectively at generally opposite ends of the second side wall 957. As will be discussed further below, the first and third indentations 966 and 968, respectively, share in common a first shape that includes an elongated indented portion 970, and are respectively located at respectively opposite ends of the first and second side walls 956 and 957, respectively. By comparison, the second and fourth indentations 967 and 969, respectively, share in common a second shape that lacks the elongated indented portion, and are located at respectively opposite ends of the first and second side walls 956 and 957, respectively. Additionally, it will be appreciated that the roof 954 of the main outer shell 952 includes an orifice 971 and the flat internal compression structure 958 also includes snap-in cage nut having a threaded internal orifice 972 that is generally aligned with the orifice 971 when the ear extensions 960 are within the complementary slots 962.

Figure 19:
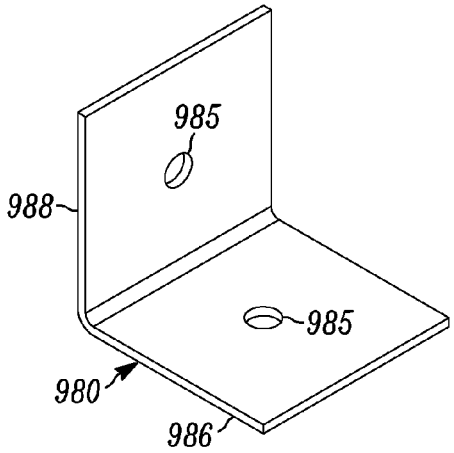
FIG. 19 is a perspective view of an example retainer bracket.
Figure 20:
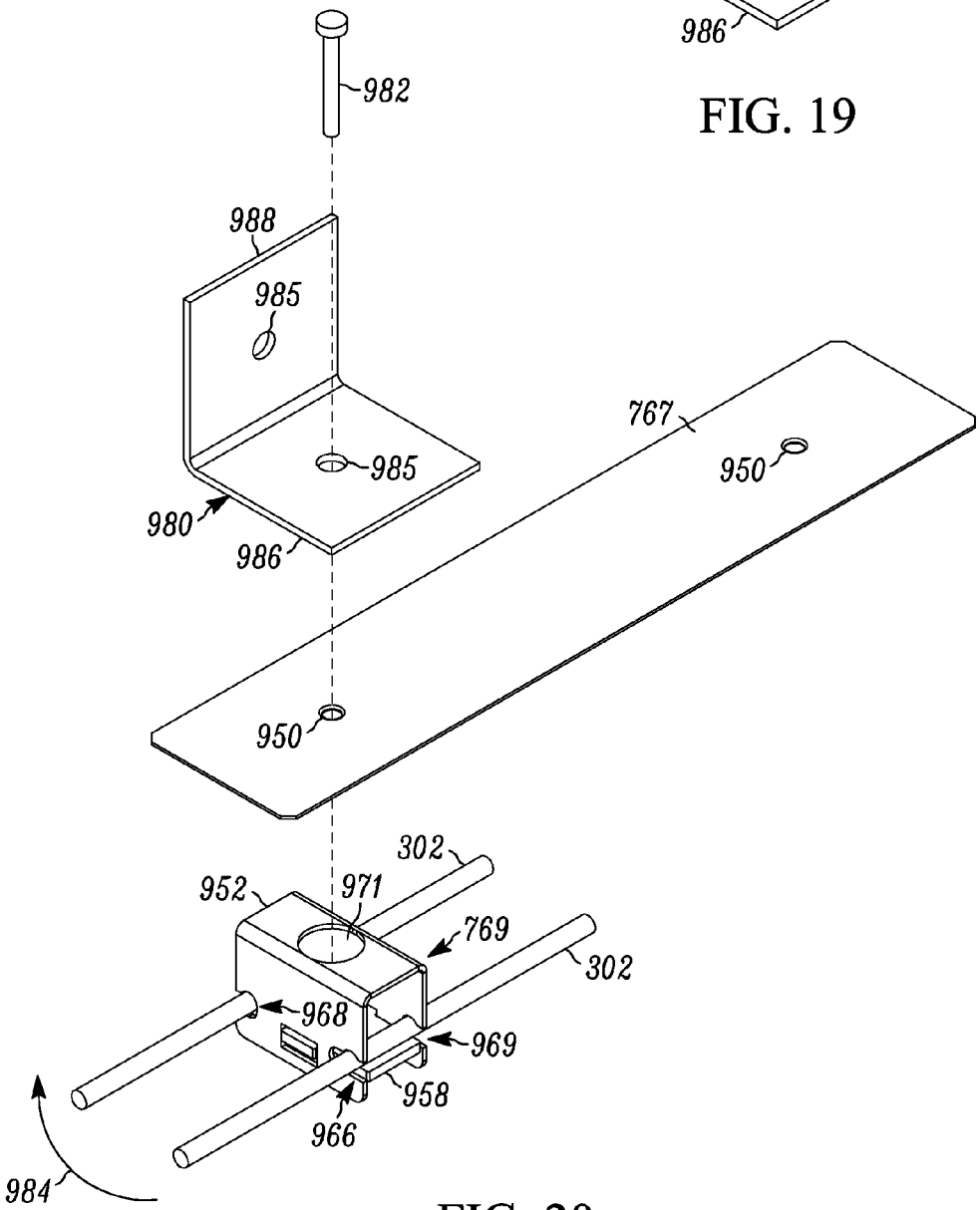
FIG. 20 is an exploded, perspective, partly cutaway view of the deck retainer clamp of FIGS. 17A-17D, the additional cover structure of FIG. 18, the retainer bracket of FIG. 19, a bolt, and wire tendons in relation to one another.

Turning to FIG. 20, an exploded perspective, partly cutaway view is provided of the deck retainer clamp 769 in relation to each of the additional cover section 767 of FIG. 18, an additional retainer bracket 980, a retaining bolt 982, and the pair of wire tendons 302. FIG. 20 particularly indicates how the deck retainer clamp 769 can be positioned onto the pair of wire tendons 302 and, once so positioned, be clamped to those wire tendons and additionally to the additional cover section 767 of FIG. 18 and to the further retainer bracket 980, a perspective view of which is also shown in FIG. 19, simply by way of the bolt 982. More particularly, it can be appreciated that the deck retainer clamp 769 first can be positioned onto the wire tendons 980 by first positioning the deck retainer clamp generally in between the wire tendons so that the channel 964 is generally aligned with the lengths of the wire tendons, and then rotating the deck retainer clamp in a direction indicated by an arrow 984 so that the wire tendons are fit into the first, second, third, and fourth wire receiving indentations 966, 967, 968, and 969. It will be appreciated that this process of rotating the deck retainer clamp 769 into position in this regard is facilitated by the elongated indented portions 970 of the first and third wire receiving indentations 966 and 968.

Additionally, with the deck retainer clamp 769 positioned onto the wire tendons 302, then the additional cover section 767 is positioned so that one of the bolt holes 950 is over the orifice 971 and particularly aligned with the threaded internal orifice 972. Further, the retainer bracket 980, which in the present embodiment is an L-shaped bracket having two orifices 985 that are located respectively on each of a horizontal wall portion 986 and a vertical wall portion 988 of the bracket, is aligned so that the orifice 985 on the horizontal wall portion 986 is also aligned with the threaded internal orifice 972. With all of these components so aligned and positioned so that the additional cover section 767 is atop the roof 954 and the horizontal wall portion 986 is atop the additional cover section, then the bolt 982 can be inserted through the orifice 985, bolt hole 950, orifice 971 and into the threaded internal orifice 972. Rotational tightening of the bolt 982 then has the effect of rotating the cage nut within which the threaded internal orifice 972 is formed, thus causing the flat internal compression structure 958 to move upwards relative to the shell 952 so as to compress the wire tendons 302 between that flat internal compression structure and the upper surfaces of the indentations 966, 967, 968, and 969. As this occurs, the retainer bracket 980 is compressed against the deck retainer clamp 769 with the additional cover section 767 sandwiched in between, such that ultimately all of the retainer bracket, additional cover section, and the deck retainer clamp are fixedly coupled to the wire tendons 302 in a robust manner.

With respect to the retainer bracket 980 in particular, it should be appreciated such retainer brackets are only optional with respect to the implementation of any given one of the deck retainer clamps 769 and additional cover sections 767. The retainer brackets 980 can particularly be provided in areas where it is desired to fixedly mount other structures in relation to (or as part of) the wire tendons 230 and/or the panel structures 750, for example, to mount guard rails. That said, it should be evident from FIGS. 7A and 7B that, in the embodiment shown there, no retainer brackets are present. Rather, as illustrated by FIG. 7B, only the additional cover section 767 is affixed to the deck retainer clamp 769, which is particularly shown in FIG. 7B. Nevertheless, it should be particularly evident from FIGS. 7A and 7B that, thanks to the fixed coupling of the additional cover section 767 to the deck retainer clamp 769 and the fixed coupling of both of those structures to the wire tendons 302 by way of the bolt 982, the additional cover section 767 because of its edges 899 overlapping the panel sections serves not only to fill in the gap between the neighboring rows of the panel sections but also further serves to secure the panel sections in relation to the wire tendons 302.

Figure 12:
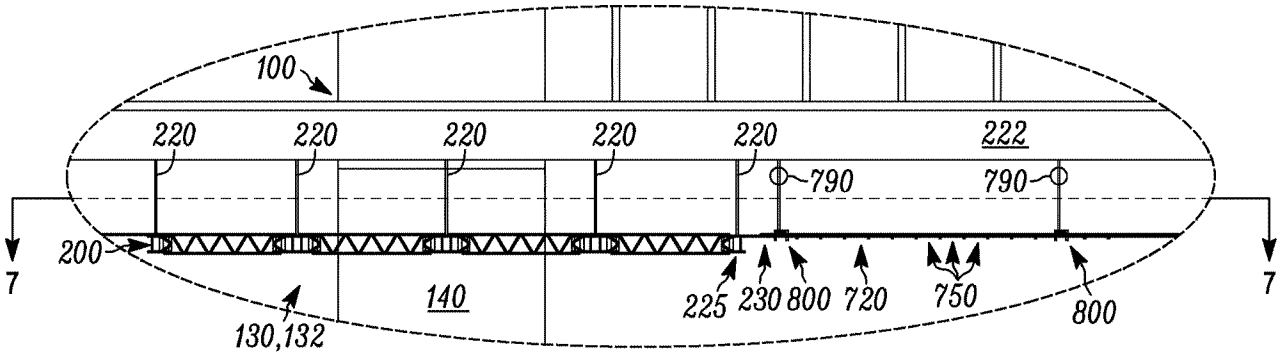
FIG. 12 is an additional enlarged detail view that shows both the same portion of the example bridge of FIG. 1 that is shown in FIG. 2 and also shows a portion of a partly completed work platform system, where the work platform system is the same work platform system as that of FIG. 2 except that the suspended subsystem of the work platform system is in a different, more advanced, state of partial implementation.

Referring still to FIGS. 7, 7A, and 7B, and also referring now to FIG. 12, in the present embodiment the further implemented suspended subsystem 720 also includes, in addition to the pairs of wire tendons 230 and the panel structures 750 supported thereon (plus the cover sections such as the cover section 767 positioned in between the rows of panel sections), suspension chains 790 that are coupled between the underside of the deck 222 of the suspension bridge 100 and the pairs of wire tendons 230 at various locations along the lengths of the wire tendons. The suspension chains 790 can be periodically spaced along the lengths of each of the pairs of the wire tendons 230, and the number of such suspension chains can vary depending upon the circumstances or embodiment. FIG. 12 shows particularly two of the suspension chains that have been positioned along at least the fourth pair of wire tendons 304, upon which are supported the third and fourth rows of the panel sections 753 and 754 that are fully complete in that each of those rows (unlike the other rows 751, 755, 756, 757, and 758) include panel sections 750 that have been implemented along the entire length of the fourth pair of wire tendons 304.

It should be appreciated that, although not clearly apparent from FIG. 12, one or more of the suspension chains 790 are provided in relation to each of the pairs of wire tendons 230 (e.g., in relation to each of the wire tendon pairs 301, 302, 303, 304, 305, 306, 307, 308, and 309 in the example of FIG. 7). Each of the suspension chains 790 along a particular pair of the wire tendons 230 is installed typically only when a sufficient number of the panel sections 750 have been installed onto that pair of wire tendons so as to allow work personnel to walk out to the respective location at which the respective suspension chain is to be attached. Although the number of the suspension chains 790 along each of the pairs of wire tendons 230 can be the same and the relative spacing of the suspension chains 790 along each of the pairs of wire tendons are identical in the present embodiment, this need not be the case in all embodiments. For example, in another alternate embodiment, it is possible that suspension chains 790 will be provided with a first spacing frequency along the length of one pair of the wire tendons and provided with a different spacing frequency along the length of another pair of the wire tendons.

Figure 14:
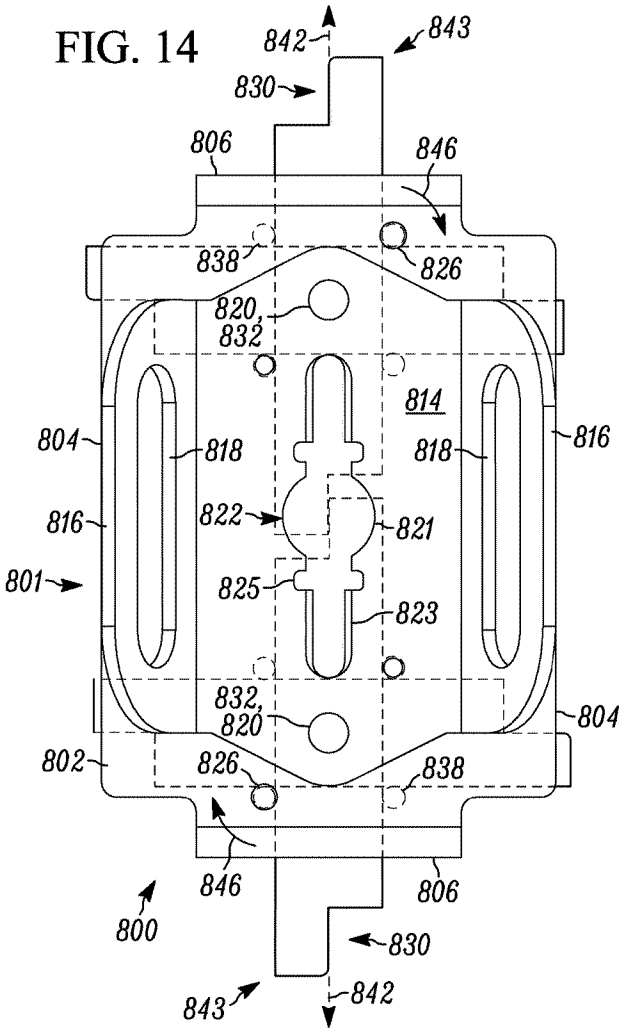
FIG. 14 is a top plan view of the suspender clamp shown in FIG. 13, with certain portions of the suspender clamp shown in phantom.
Figure 13:
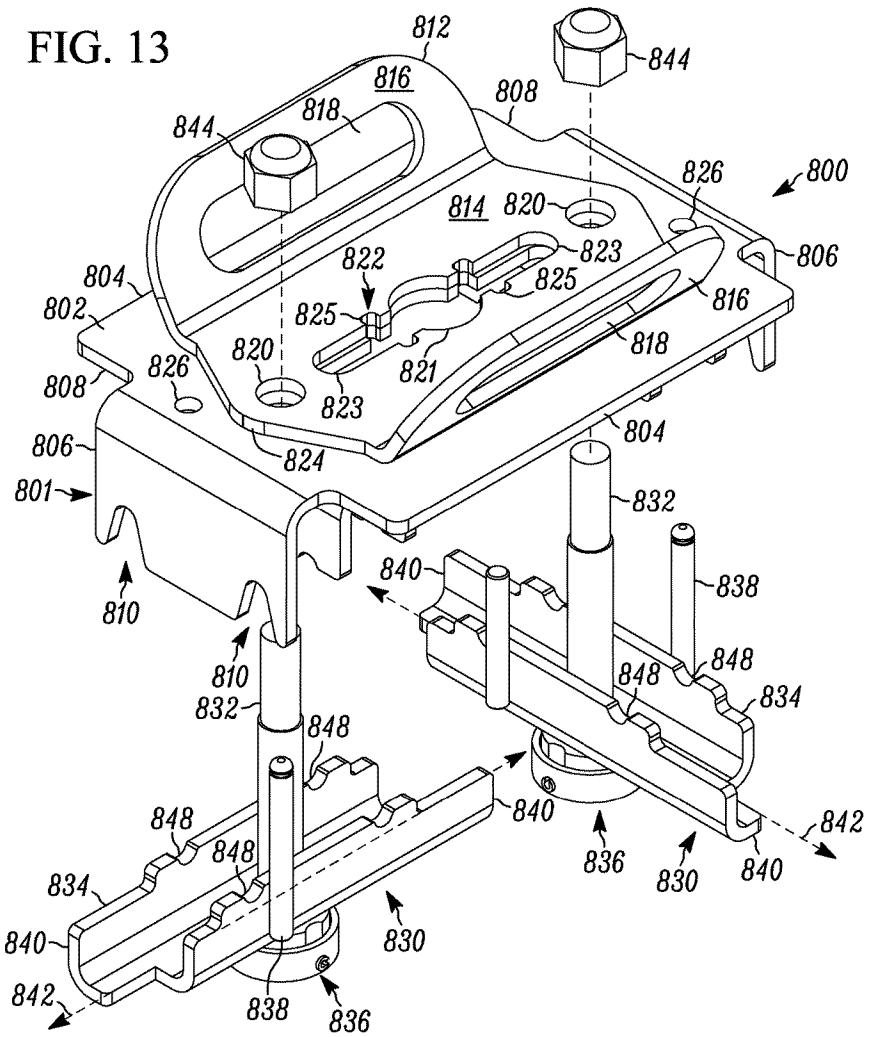
FIG. 13 is an exploded perspective side view of an example suspender clamp included in the partly completed work platform system as shown in FIGS. 12, 7, 7A, and 7B.

Further as shown, in order to couple the suspension chains 790 to the pairs of wire tendons 230, in the present embodiment, suspender clamps 800 are employed, one of which is shown in each of FIGS. 7A and 7B and others of which are shown in FIG. 12. Referring further to FIGS. 13 and 14 in this regard, an exploded perspective side view of one of the suspender clamps 800 and a top plan view of the suspender clamp 800 are shown, respectively, to illustrate particular features of the suspender clamp 800. As shown, the suspender clamp 800 includes a top planar (or substantially planar) surface 802 that extends between side edges 804 and further includes downwardly extending bracket extensions 806 positioned at each of first and second ends 808 of the suspender clamp 800. Similar to the wire tendon support extensions 770 of the panel sections 750, the bracket extensions 806 each include a respective pair of indentations 810 that are intended to cover over and receive wire tendons of a given pair of the wire tendons 230 so that the claim 800 is positioned into place relative to the pair of wire tendons, for example as shown in FIG. 7B. Additionally, the top planar surface 802 has a width between the side edges 804 that is substantially equal to that of the additional cover structures 767 that, as discussed above, can be provided to extend between neighboring panel sections 750 of the rows of panel sections. Thus, the top planar surfaces 802 of the suspender clamps 800 can serve a similar purpose of filling in the gaps between neighboring panel sections of neighboring rows of panel sections, particularly at the locations along the pairs of wire tendons 230 at which the suspender clamps are positioned.

Further as shown, the suspender clamp 800 includes a main body 801 having a top handle portion 812 that includes a planar portion 814 that overlays the top planar surface 802 along much of that surface and further includes two upwardly extending handle portions 816 that extend upward from the planar portion 814 diagonally upwards, that is, both upwards away from the top planar surface 802 and generally outwards toward the respective side edges 804 of the suspender clamp 800. Each of the handle portions 816 includes a respective slot 818 by which work personnel implementing the suspender clamp 800 can grasp the suspender clamp. Further as shown, the top planar surface 802 as well as the planar portion 814 include three additional holes or orifices, namely, first and second end orifices 820 that are circular and an intermediate orifice 822 that is oblong. The end orifices 820 are respectively positioned proximate opposite ends of the intermediate orifice 822, in between those respective opposite ends of the intermediate orifice 822 and outer end tips 824 of the planar portion 814. Further, additional orifices 826 that are also circular and of smaller diameter than the orifices 820 are positioned proximate the bracket extensions 806 of the top planar surface 802. Each of the additional orifices 826 is positioned generally to the side of a respective one of the outer end tips 824 of the planar portion 814.

The intermediate orifice 822 as shown includes a central region 821, end slot regions 823, and intermediate transverse slot regions 825 that allow the intermediate orifice to serve as an attachment feature by which one (or potentially more than one) of the suspension chains 790 can be attached to the suspender clamp 800. Although not shown in detail in FIGS. 13 and 14, it should be understood that one of the suspension chains 790 can be attached by inserting a free end of the suspension chain through the central region 821 of the intermediate orifice 822 and then sliding the suspension chain over and into one of the end slot regions 823. Once the suspension chain 790 is placed within one of the end slot regions 823, a suspension chain retainer pin (not shown) is placed in that one of the transverse slot regions 825 that is adjacent that end slot region so that the suspension chain 790 is kept retained in that end slot region. The suspension chain 790 and intermediate orifice 822 (and particularly the end slot regions 823) are sized and configured so that, upon proper placement of the retainer pin within the appropriate transverse slot region, the suspension chain is effectively locked to the main body 801 of the suspender clamp 800 and is unable to slip, vertically or horizontally, from its position in the end slot region 823. This locking system effectively fixes the suspender clamp 800 to the suspension chain 790. Additionally, in some embodiments, an additional "zip tie" or other tag type structure may be placed between a hole in the retainer pin and an adjacent portion of the suspension chain 790 to provide a visual aid to the installer to ensure that the retainer pin has been installed.

In contrast to the intermediate orifice 822, the orifices 820 and 826 allow for assembly of first and second grasping portions (or clasp portions) 830 to the main body 801 of the suspender clamp 800 in a manner that allows the suspender clamp to grasp the wire tendons of a pair of the wire tendons 230 and lock the suspender clamp in relation to those wire tendons such that tension force provided by the suspension chain 790 can be applied to the wire tendons and hold those wire tendons in place relative to the deck 222. More particularly as shown, each of the grasping portions 830 includes a central post 832 that extends upward from a central location 836 along a horizontally extending portion 834 that extends outward in opposite directions from that central location. Further as illustrated, each of the grasping portions 830 also includes an additional post 838 that is offset radially from the central location 836 and central post 832 and that has a smaller diameter than the central post. More particularly as shown, the location of the additional post 838 is still relatively close to the central post 832 by comparison with how close ends 840 of the horizontally extending portion 834 are located relative to the central post 832, but also is offset from a central axis 842 (that is, shifted to the side of that central axis 842) extending between the ends 840.

Implementation of the suspender clamp 800 in relation to a pair of the wire tendons 230 proceeds by first inserting the respective central posts 832 of the two respective grasping portions 830 into the respective end orifices 820 of the main body 801 from underneath the main body, with both of the grasping portions rotated so as to be axially aligned with the central axis 842, such that the grasping portions are in starting orientations 843 as shown in FIG. 14. Once the central posts 832 are inserted through the end orifices 820, the central posts 832 are coupled to the main body 801 by way of nuts 844 so as to retain the grasping portions 830 in relation to the main body 801. With the grasping portions 830 oriented in this manner, it is then possible to install the suspender clamp 800 (to which a suspension wire 790 can already have been coupled as discussed above) onto the pair of wire tendons 230, so that the wire tendons 230 proceed into the indentations 810. Alignment of both of the grasping portions 830 in the starting orientations 843 aligned with the central axis 842 allows for the grasping portions to be slipped initially in between the wire tendons of the given pair of wire tendons.

Once the suspender clamp 800 is in position relative to the pair of wire tendons 230 as discussed above, then the grasping portions 830 are further rotated ninety degrees) (90°, in the present example in a clockwise manner as indicated by arrows 846, until the additional posts 838 (and particularly tips/heads thereof) become aligned with the additional orifices 826. This rotation can be accomplished by way of torque bolts. Once this has occurred, the nuts 844 can be further tightened so as to cause the grasping portions 830 to move upward towards the main body 801 and grasp fixedly the pair of wire tendons 230 extending between the grasping portions and the main body. Indentations 848 formed along upper side edges of the horizontally extending section 840 of each of the grasping portions 830 further enables the wire tendons to be grasped in this manner.

As will be appreciated, the suspension chains 790 by virtue of the suspender clamps 800 serve to provide extra support to the further implemented suspended subsystem 720 at locations in between the portions 132 and 134 of the support subsystem 130 (e.g., the two portions located respectively at the two towers 140) to which the ends of the further implemented suspended subsystem 720 and wire tendons 230 thereof are coupled. Such extra support helps to keep the support subsystem 130 flat (or substantially flat) along its length, and to eliminate or reduce undulation occurring along its length. Additionally it should be appreciated, particularly with reference to FIG. 7B, that the suspender clamps 800 with the grasping portions 830 (and horizontally extending portions 834 thereof) also serve a purpose similar to that of the additional cover structures 767 in terms of helping to retain in position the panel sections 750. As is evident from FIG. 7B, when implemented in relation to one of the suspender clamps 800, the panel sections 750 extend beneath the side edges 804 of the top planar surface 802 of the suspender clamp. Also as shown in FIG. 7B, in addition to the panel sections 750 extending beneath the side edges 804 of the suspender clamp 800, the grasping portions 830 (and horizontally extending portions 834 thereof) of the suspender clamp 800 when rotated into position also are positioned so that the panel sections 750 (and particularly the end struts 764 thereof) are situated in between the ends 840 of the horizontally extending portions 834 and the side edges 804. Thus, the horizontally extending portions 834 further serve to assist with retaining in place the panel sections 750.

Figure 21:
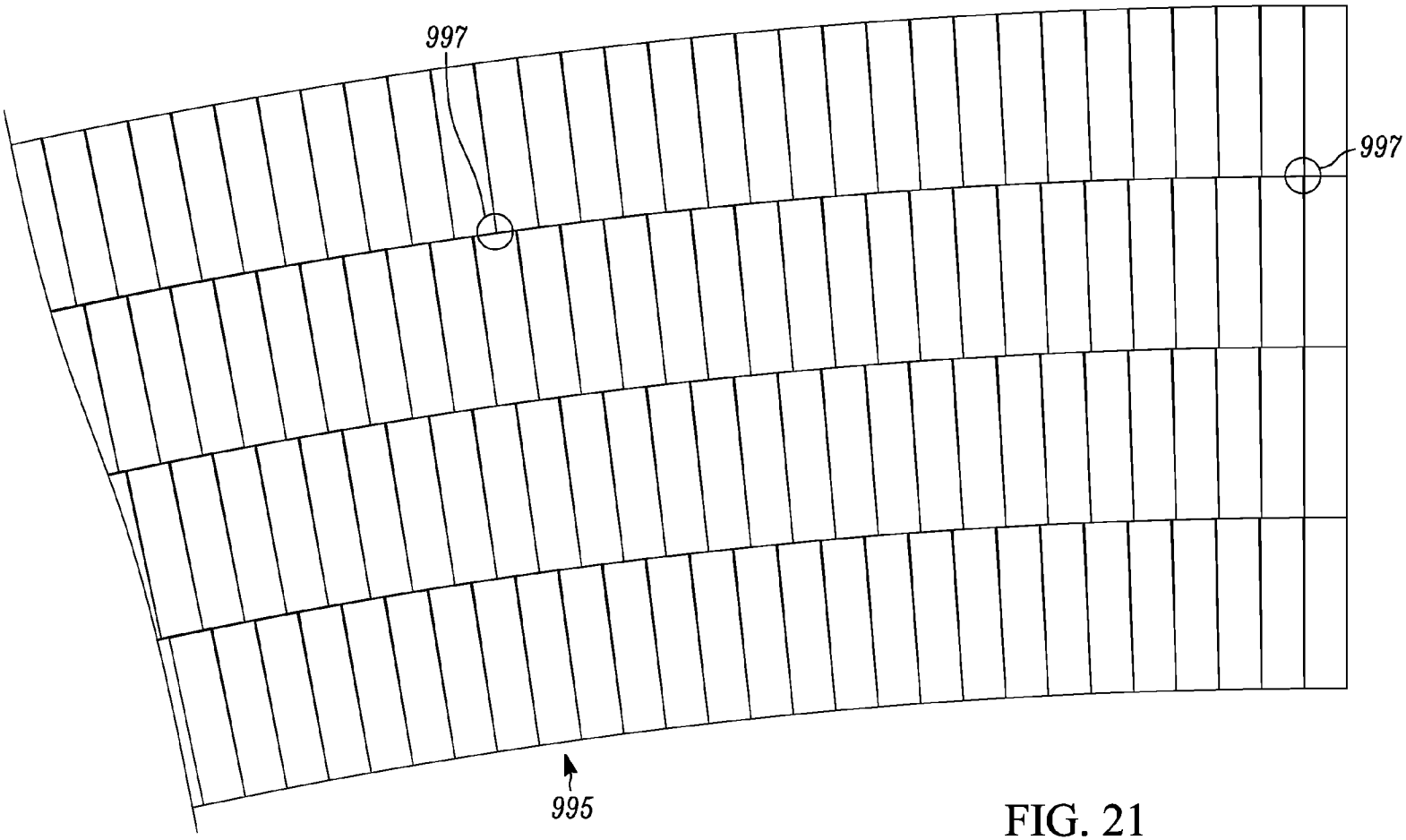
FIG. 21 is a schematic illustration of a portion of an example suspended subsystem that is implemented in a nonlinear manner.

It should be noted that, although the embodiment of work platform system shown in FIGS. 1, 3, 7, etc. is a system in which the suspended subsystem is intended to extend not only generally horizontally between the portions 132, 134 of the support subsystem 130 but also generally linearly due to the fact that the suspension bridge 100 itself is a linear structure, it is envisioned that other embodiments of the work platform system can or will need for a suspended subsystem to be implemented in manners that are nonlinear, for example, in a curving manner as illustrated schematically by a suspended subsystem 995 shown in FIG. 21. Nonlinear implementations of this type can raise special implementation concerns because, as illustrated in FIG. 21 for example, although panel sections from different rows may at certain locations be aligned or "in phase", for example, as shown at a location 997, at other locations such as a location 999 the panel sections may no longer be aligned or be "in phase". Although this in and of itself may not always pose a difficulty, difficulties can arise particularly when out of phase panel sections make it difficult to fit in desired suspender clamps 800 to allow for desired suspension chains 790 to be installed. Nevertheless, such difficulties can be alleviated through the use of panel sections of differing sizes that allow for reestablishment of alignment among the panel sections of different rows. For example, realignment between the rows of panel sections at the location 997 of FIG. 21 can be achieved by introducing a row panel in one of the rows that is half of the length of the standard-size row panel being utilized otherwise.

From the above discussion, it should be appreciated that the further implemented suspended system 720 of FIGS. 7 and 12, as with respect to the suspended system 120 of FIGS. 1 and 3, is in a partially completed form. That is, although some of the panels sections 750, suspension chains 790, suspender clamps 800, and cover sections 767 are shown to be implemented in relation to FIGS. 7 and 12, there nevertheless remain regions along the pairs of wire tendons 230 at which panel sections and other components mentioned above are not yet installed. More particularly, even though FIG. 7 suggests that the rows of panel sections 753 and 754 may be fully complete rows of the panel sections 750 that extend the full length of the pair of wire tendons 304 in between those rows of panel sections, as shown the other rows of panels 751, 752, 755, 756, 757, and 758 still require the installation of additional panel sections 750.

Nevertheless from the above description, it can be appreciated from FIGS. 7 and 12 that, upon the addition of further ones of the panel sections 750, cover sections 767, suspension chains 790, and suspender clamps 800 along the entire lengths of all of the pairs of wire tendons 230, the further implemented suspended subsystem 720 will eventually be modified to attain a fully implemented state. More particularly, as shown in FIG. 15, completion of this process will result in a fully implemented work platform system 860 provided on suspension bridge 100 as shown, where the fully implemented work platform system not only includes the two portions 132 and 134 of the support subsystem 130 that are mounted on the two towers 140 of the suspension bridge (as already discussed with reference to FIG. 7), but also includes a fully implemented suspended subsystem 880 extending between those two portions of that support subsystem, where the fully implemented suspended subsystem 880 includes multiple ones of the suspension chains 790 along its length that are coupled to the deck 222 of the suspension bridge.

More particularly in this regard, it should be evident from the discussion provided in relation to FIGS. 7, 7A, 7B, and 12 that the further implemented suspended subsystem 720 can be modified to attain the fully implemented suspended subsystem 880 particularly by (a) positioning additional ones of the panel sections 750 along the entire lengths of the pairs of wire tendons 230 so that each of the rows 751, 752, 753, 754, 755, 756, 757, and 758 includes a full set of the panel sections extending all or substantially all of the distance between the two portions 132 and 134 of the support subsystem 130 mounted on the two towers 140, (b) coupling sufficient or appropriate numbers of the suspension chains 790 between the deck 222 of the suspension bridge 100 and the wire tendons 230 by way of associated ones of the suspender clamps 800, which also serve to retain in place the panel sections 750 relative to the wire tendons 230, and (c) providing additional cover structures 767 between the rows of panel sections 751, 752, 753, 754, 755, 756, 757, and 758 to eliminate any gaps existing between those rows that exist notwithstanding the presence of the suspender clamps 800, and to serve to retain the panel sections 750 in place relative to the wire tendons 230.

Figure 15:
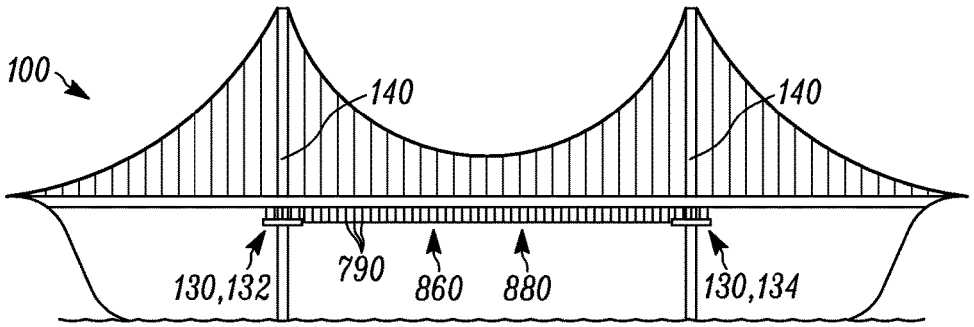
FIG. 15 is a side elevation view of the example bridge of FIG. 1, along with the work platform system of FIG. 1 after the work platform system has been fully implemented in relation to the bridge.
Figure 16:
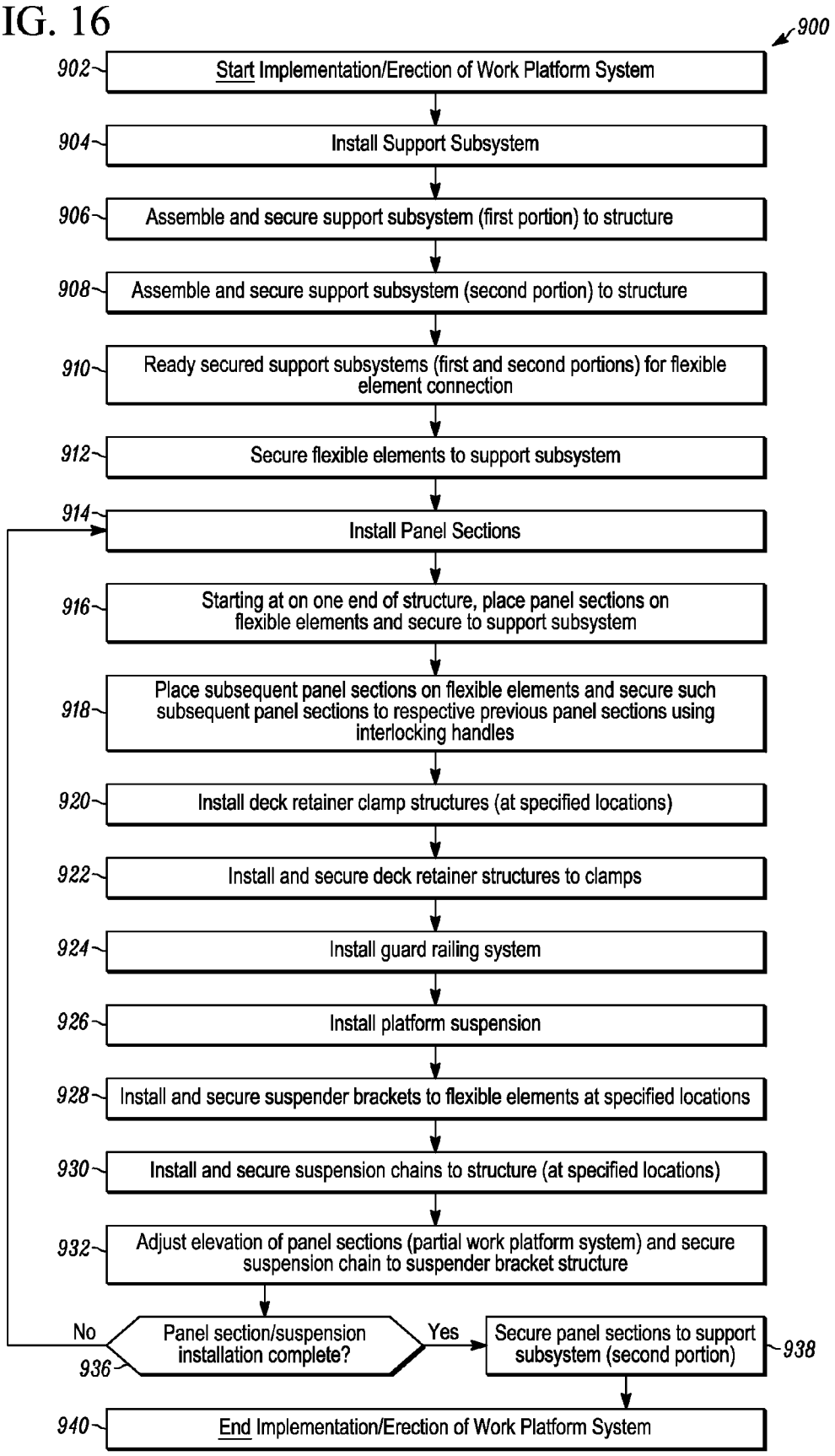
FIG. 16 is a flow chart showing example steps of a process of implementation of the work platform system in relation to the bridge of FIGS. 1 and 15.
Figure 17B:
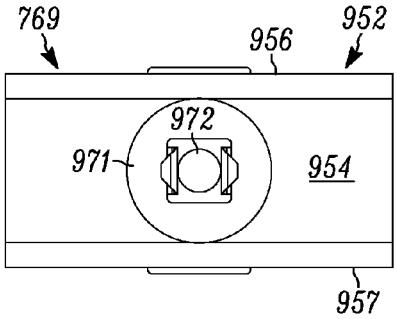
FIGS. 17A, 17B, 17C, and 17D respectively show side perspective, top plan, side elevation, and end elevation views of an example deck retainer clamp.
Figure 17A:
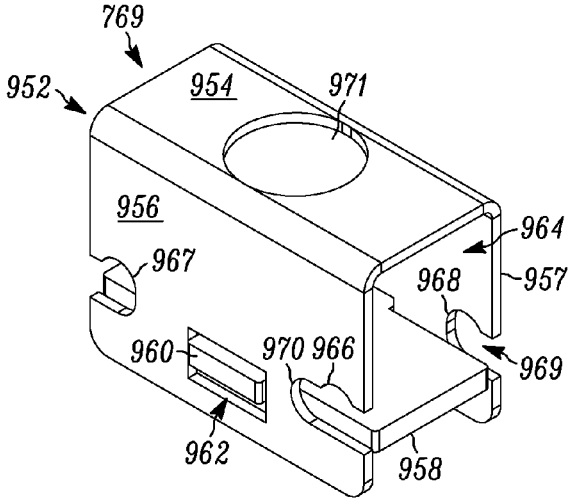
Figure 17C:
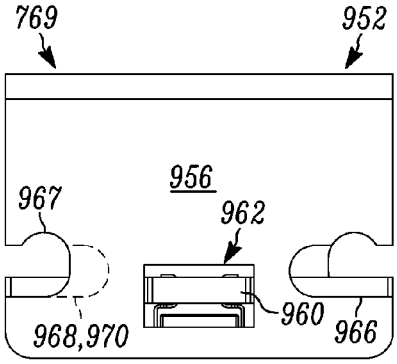
Figure 17D:
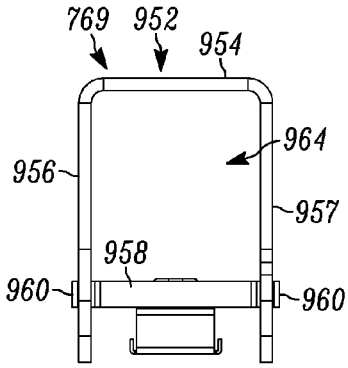

To further illustrate steps of implementation/installation/erection of the fully implemented work platform system 860 of FIG. 15, a flowchart 900 is further provided in FIG. 16, the flowchart illustrating such steps in accordance with exemplary embodiments of the present disclosure. It will be understood that the steps of the flowchart 900 generally correspond to the description already provided above relating to FIGS. 1-15.

As shown, upon the process commencing at a start step 902, the process first involves a step 904 of assembling/installing a support subsystem such as the support subsystem 130. The step 904 includes performing of a first substep 906 that involves assembling and securing a first portion of the support subsystem (e.g., the first portion 132) at one end of the structure, and another substep 908 that involves assembling and securing a second portion of the support subsystem (e.g., the second portion 134) at another end of the structure. In the substeps 906 and 908, it will be understood that installation and securing of the respective portions of the support subsystem includes the implementation of any appropriate suspension, anchoring, and/or bracing structures as needed and, additionally, that such installation and securing occurs at a desired elevation or height (e.g., a desired distance above ground level).

In accordance with at least some embodiments, a substep 910 is also performed that includes providing and installing structures, such as adaptor brackets (not shown) to each of the support subsystem portions (for example, at leading edges of the support subsystem portions), with this substep serving to ready or configure the respective support subsystem portions to be connected to flexible elements such as the pairs of wire tendons 230 discussed above. Next, in a step 912, the flexible elements (again, e.g., the pairs of wire tendons 230) are secured to the respective portions of the support subsystem, such as by way of the adapter brackets previously mentioned. Attachment of these flexible elements typically will also establish multiple rows between the flexible elements (e.g., between the different pairs of wire tendons). Attachment of the flexible elements begins the installation of the suspended subsystem as discussed above, which ultimately results in the implementation of a fully implemented suspended subsystem such as the fully implemented suspended subsystem 880 and thus, viewed in combination with the support subsystem 130, implementation of a fully implemented work platform system such as the fully implemented work platform system 860 mentioned above.

Upon the flexible elements being attached, then the process advances to a step 914 that involves installing panel sections such as the panel sections 750. The step 914 includes several substeps 916, 918, 920, 922, and 924 as shown. The substep 916 is initially performed as one starts installation of the panel sections at one end of structure, e.g., at the first portion 132 discussed above. This substep involves placing a plurality of the panel sections on a plurality of the flexible elements and securing the panel sections to a portion of the support subsystem 130 (again, e.g., the first portion 132) and can involve the implementation of specialized panel structures or other structures that allow for a smooth transition (e.g., a smooth floor surface) to be maintained as one proceeds from the support subsystem to the suspended subsystem.

Next, at the substep 918, the process includes placing subsequent or additional ones of the panel sections 750 on a plurality of the flexible elements and securing such subsequent or additional panel sections to the respective previous panel sections using handle support extensions such as the handle support extensions 780 discussed above. This step is typically performed with respect to each of the rows of the suspended subsystem as established by the different flexible elements. Further, this step of placing and securing the panel sections 750 in at least some embodiments can involve positioning and lowering of panel sections in a particular manner. For example, positioning and lowering of a panel section can be performed entirely by hand by work personnel, or by way of machinery, and/or involve an extension connector such as a lanyard. In the case where a lanyard or similar ropelike connector was utilized, such connector would be attached to the handle support extensions tending to rotate away from the work personnel during installation of the panel section (e.g., the handle support extensions that would be at the top of the additional panel section 790 if it was shown in FIG. 11A) and, by way of holding the unattached end of the lanyard, the work personnel could lower the panel section in a controlled manner.

Further, at the substep 920, deck retainer clamp structures such as the deck retainer clamps 769 are installed in relation to the flexible elements, typically at desired, predetermined and/or specified locations along the flexible elements. Although shown as occurring sequentially after the substep 918, it is contemplated that the substep 920 can take place generally as the panel sections 750 are placed on the plurality of flexible elements in accordance with the substep 918. Additionally, at the step 922, deck retainer structures (e.g., the additional cover structures 767) are installed and secured to the deck retainer clamp structures using retaining or connecting structures (e.g., bolts such as the bolt 982). This substep 922 also can take place generally as the panel sections 750 are placed on the plurality of flexible elements. Finally, as indicated by the substep 924, in some embodiments a guard railing system also is installed with respect to the panel sections 750 and it is contemplated that this substep too can take place generally as panel sections 750 are placed on the plurality of flexible elements. The guard railing system can be implemented by attachment of guard rail structures to a variety of other structures including, for example, retainer brackets such as the bracket 980 or features such as the orifices 781 associated with the panel sections.

Next, as represented by a step 926, installing of platform suspension structures takes place, and this includes substeps 928, 930, and 932 as shown. Although shown in the flowchart 900 of FIG. 16 as occurring subsequent to the installing of the panel sections in accordance with the step and substeps 914, 916, 918, 920, 922, and 924, in other embodiments the step 926 and associated substeps 928, 930, and 932 can occur substantially contemporaneously with the step and substeps 914, 916, 918, 920, 922, and 924. As indicated, the substep 928 involves installing and securing suspender bracket structures, such as the suspender clamps 800, to the flexible elements (again, e.g., the wire tendons 230) at desired, predetermined and/or specified locations. Next, the substep 930 is performed, which includes installing and securing suspension structures (e.g., the suspension chains 790) to beam clamps or other portions/members of the structure in relation to which the work platform system is being implemented (e.g. to locations along the deck 222 of the suspension bridge 100) at desired, predetermined and/or specified locations along the structure.

Then, at the further substep 932, adjustment (e.g., raising or lowering) of the elevation of the panel sections 750 (connected to the flexible elements) and additionally securing (for example, using a chain retaining structure as previously described) of the suspension structures to the suspender bracket structures are performed. For example, one or more of the suspension wires 790 can be attached to the suspender clamp(s) 800 by way of the intermediate orifice(s) 822 thereof such that tension is applied to the clamp(s) and thus to the flexible elements. It should be noted that tools, such as a suspender adjustment tool, can be used to adjust or accomplish elevation adjustment. Additionally, it should also be noted that the process of installing the suspender bracket structures such as the suspender clamps 800 at the substep 928 can particularly involve positioning the suspender clamps onto the flexible elements and then rotating and tightening the grasping portions 830 so as to affix the clamp(s) to the flexible elements (and also so that the ends of panel sections 750 are locked in place between the grasping portions 830 and the top planar surfaces 802 of the suspender clamps). Depending upon the embodiment, the suspension wire(s) can alternatively be coupled to the clamp(s) 800 prior to the grasping portion(s) 830 being rotated and locked in place relative to the flexible elements.

If at the step 936 it is determined that the installation of panel sections 750 is not complete with respect to any one or more of the rows of panel sections, the steps and substeps associated with installation of the panel sections 750 and platform suspension structures continues are repeated, by returning to step 914. It should be noted that, in this circumstance, upon repeating the substeps associated with the step 914 in particular, the substep 916 typically would no longer be applicable and would be skipped (since implementation of the panel sections would typically no longer be occurring right at the junction between the support subsystem and the flexible elements). Accordingly, the steps and substeps 914-936 are generally repeated until the other end of the structure (e.g., the second portion 134) is reached. That said, upon it being determined at the step 936 that the installation of panel sections 750 is complete with respect to all of the rows, the panel sections will be finally secured (e.g., using an adaptor bracket structure), at step 938, at the second portion of the support subsystem (e.g., the portion 134), and then the process concludes at the step 940. It should be appreciated that, although the flowchart 900 envisions that installation is complete when a far end of the suspended subsystem (e.g., at the portion 134) has been reached, completion also could be achieved, in other embodiments, by reaching some other location or attaining some other level of implementation.

It should be appreciated that the work platform assembly, subsystems, and components thereof, and methods of implementation/installation and utilization relating thereto that are described above are advantageous in one or more respects depending upon the embodiment. For example, the intermeshing handle support extensions 830 allow not only for supporting the panel sections 750 but also allow adjacent panel sections to be linked to one another and to provide support for and self-brace one another (e.g., the handle support extensions 830 of one panel section extending beneath the side strut of an adjacent panel section help to provide further support for that adjacent panel section). Indeed, the handle support extensions 830 facilitate keeping the top panel surfaces of adjacent ones of the panel sections substantially aligned with minimal changes in elevation of the top panel surfaces of neighboring panel sections relative to one another. The panel sections 750 also are easy for stacking and shipping.

Also, through the use of appropriately-positioned ones of the suspension wires 790, the overall working surface (e.g., the surface on which work personnel walk) provided by the work platform system is substantially flat. Further, through the use of pairs of tendons, rather than single tendons, extending between the support subsystem (platforms) and supporting the panel sections, significant redundancy is built into the work platform system. Additionally, numerous components of the work platform system are modular and/or interchangeable, and/or can be reused again and again in relation to the implementation of new work platform systems in relation to additional structures.

It should also be appreciated that the work platform assembly, subsystems, and components thereof, and methods of implementation/installation and utilization relating thereto that are described above are only intended as examples, and the present disclosure is intended to encompass numerous variations of the above-described concepts. For example, a variety of panel sections of different sizes and shapes can be employed depending upon the embodiment and, indeed, in some embodiments, panel sections of different sizes and shapes are implemented together in a single work platform system. The use of panel sections of different widths and/or lengths can also be appropriate depending upon the circumstance. For example, in some embodiments or circumstances, panel sections having different sizes in terms of the width dimension discussed above (e.g., the width dimension 759 of FIG. 8) extending between different pairs of the wire tendons can be appropriate for different rows, to accommodate variable spacing of the wire tendons of different pairs of those wire tendons. This can be appropriate, further for example, to accommodate variable spacing between different ones of the hubs of 310 of the support system to which the wire tendons at their ends are attached.

Also, in some embodiments or circumstances, panel sections having different sizes in terms of the length dimension discussed above (e.g., the length dimension 761 of FIG. 8) can be provided. The use of panel sections having different lengths allows for the overall work platform system to be advantageously implemented as necessary in view of the environment and other circumstances. For example, the use of panel sections of different lengths allows the panel sections to more closely be fit to obstacles (e.g., a pipe sticking from a bridge structure), curve platform fit contoured structures, or provide an ability to space wire tendon support extensions (which also can be referred to as tendon hooks) 770 in a manner that facilitates the installation of suspender clamps 800 (which also can be referred to as suspender clamps). Further, in some embodiments, any of a variety of different numbers and types of handle support extensions (or simply interlocking handles) can be employed for interlocking or linking any two or more of the panel sections, and the handle support extensions need not be identical in number, size, or shape to the handle support extensions 780 shown in FIG. 8.

The use of handle support extensions can provide numerous functions including, for example: (a) securing panel sections together during assembly so that the panel sections do not slide apart from one another; (b) improving of the ease of platform assembly, insofar as the handle support extensions provide guidance and support for panel sections during assembly and disassembly; (c) increasing panel section stiffness by virtue of allowing for the transfer of loads from one panel section to another panel section; (d) minimizing the degree to which neighboring panel sections have surfaces that are not aligned (e.g., eliminating steps between neighboring panels and enhancing the degree to which the various neighboring panel sections form an overall surface that is substantially flat); (e) facilitating the assembly of panel sections in applications where the work platform system is extending downhill, by preventing panel sections from sliding away before the panel sections can be secured to wire tendons/cables; and/or (f) facilitating the handling, packing and securement of panel sections prior to delivery of the panel sections to a jobsite.

As already indicated above, the particular number, size, shape, and arrangement of handle support extensions associated with a given panel section can vary depending upon the embodiment or circumstance. Although in some work platform systems all of the panel sections will have identical handle support extensions, in other embodiments, one or more panel sections can have first arrangement of one or more handle support extensions even while one or more other panels sections have another arrangement of one or more handle support extensions. Among the various possible arrangements of handle support extensions that are possible are the following, for example: (a) a first arrangement in which there is only a single handle support extension on one side of a panel section; (b) a second arrangement in which there are two or more handles on only one side of a panel section (but no handle support extensions on the other side of the panel section); (c) a third arrangement in which there is a single handle support extension (but not more than one such extension) on each side of the panel section; and (d) a fourth arrangement in which there is more than one handle support extension on both of the sides of the panel section.

It should further recognized that the present disclosure is intended to encompass handle support extensions that have any of a variety of different shapes, as well as panel sections that include not only one or more handle support extensions but also one or more other features that serve one or more of the purposes of the handle support extensions as well. For example, in some embodiments, a panel section can include a flat U shaped handle support extension that serves to support adjacent panel section (such a handle support extension would be positioned so as to extend under a side strut of a neighboring panel section). Alternatively for example, in some embodiments, a panel section can include a flat U shaped handle support extension that serves to support an adjacent panel section and that also serves to receive or accept an interlocking device from the adjacent panel section.

Further for example, in some embodiments, a panel section can include a flat U shaped handle support extension that serves to support an adjacent panel section and the panel section can further include an additional feature that is configured to interlock with the adjacent panel section (or configured to receive an interlocking feature of the adjacent panel section). Additionally for example, in some embodiments, the panel section can include a U shaped handle with a 90 degree bend on one side only to secure adjacent panel sections together, as already discussed with reference to FIG. 8. And numerous other possible arrangements of handle support extensions are possible an encompassed herein as well. Also, it should be appreciated that in some alternate embodiments the support extensions referred to herein as handle support extensions need not at all be directed to (or need not primarily be directed to) serving as handles by which work personnel (or machinery) can grasp or lift or move the panel sections on which those support extensions are formed. That is, in at least some alternate embodiments, the panel sections can include one or more support extensions that are configured to allow a given panel section to provide support for and/or to be positioned in relation to (or be attached to) an adjacent panel section in a given row of panel sections (or in another arrangement of neighboring panel sections) even though such support extensions are not configured as, or employed as (or configured primarily as, or employed primarily as) handles.

Although the embodiments discussed above employ pairs of wire tendons (or other flexible linkages or elements) such as the pairs of wire tendons 301, 302, 303, 304, 305, 306, 307, 308, and 309 and employs wire tendon support extensions (or tendon hooks) such as the extensions 770 that are suited for such pairs of wire tendons insofar as the extensions have dual indentations (or notches) 772 that can be used to locate and support the panel sections on the pairs of wire tendons, it should be appreciated that such wire tendon support extensions can also be used in embodiments where only single tendons are situated adjacent to the panel sections (e.g., in embodiments where rows of the panel sections are situated between single wire tendons. Indeed, although it is envisioned that the use of pairs of wire tendons can be advantageous in that it can provide redundancy and greater system strength and robustness, and can facilitate balanced clamping of other structures to the wire tendons (e.g., balanced clamping of the tendons by the suspender clamps 800 or deck retainer clamps), nevertheless it should be appreciated that all or substantially all of the components of the fully implemented work platform system (including, for example, the suspender clamps 800) also can be employed in a work platform system that only employs single tendons running in between adjacent rows of panel sections (or running adjacent to a row of panel sections).

Additionally, numerous subcomponents of the fully implemented work platform system 860 have particular features that offer a variety of capabilities and advantages. For example, with respect to the suspender clamps 800, the handle portions 816 facilitate easy handling/grasping of the suspender clamp while also providing the necessary section required for strength and stiffness of the suspender clamp so that the clamp can bear suspender loads. Also for example, the deck retainer clamps (or rotating cable clamps) 769 facilitate fast and simple installation and securement of the deck retainer clamp (or bracket) to single or dual tendon arrangements. Further, in some embodiments, one or more of the suspender clamps or deck retainer clamps includes an indicating pin providing a visual indicator indicating whether proper assembly or implementation (e.g., proper clamping onto one or more tendons) of the suspender clamp or deck retainer clamp has been achieved. Also, in some embodiments, a visual indicator associated with the suspension clamp can facilitate fast, simple and visually verifiable securement of a suspension chain to the suspender clamp.

Further for example, it should be appreciated that each of the intermediate orifices 822 of the suspender clamps 800, due to the presence of the pairs of end slot regions 823 and intermediate transverse slot regions 825, serves as a dual chain slot by which the suspender clamp 800 can be attached not merely to one but rather to more than one (e.g., two) of the suspension chains 790 or other linkages or extensions or connectors. Also, each of the intermediate orifices 822 facilitates use of a suspender adjustor to install the suspender clamp 800. Further, in some embodiments or circumstances, the intermediate orifices 822 can be employed to allow for the installation of wind bracing chains in relation to the suspender clamps 800. Additionally, it should be appreciated with respect to the deck retainer clamps 769 that these clamps not only can provide connective structures by which the additional cover structures (or deck retainers) 767 can be affixed to the wire tendons, where the additional cover structures then further serve to prevent movement of the panel structures 750 away from the wire tendons (e.g., to prevent uplifting of the panel structures), but also the deck retainer clamps also provide connection structures by which retainer bracket can be secured in relation to the wire tendons, where the containment brackets are secured to the deck retainer clamps (at locations above the additional cover structures) and can further receive and support vertical and horizontal containment wire ropes.

It should further be appreciated that, although in at least some embodiments the work platform systems encompassed herein include both a suspended subsystem and a support subsystem, where the support subsystem includes components (such as the hubs 310 and joists 330) corresponding to the QuikDeck™ suspended access system mentioned above, this need not be the case in all embodiments. Use of a support subsystem that includes components corresponding to the QuikDeck™ suspended access system can be advantageous for any of a number of reasons including, for example, that implementation of platforms in accordance with the QuikDeck™ suspended access system can serve to provide robust anchorages at multiple locations for securing the wire tendons (e.g., the pairs of wire tendons 230) of the suspended subsystem. Indeed, such platforms provide a robust and stable surface that facilitates installation of the wire tendons.

However, notwithstanding these advantages of implementing a suspended subsystem in relation to support subsystems (platforms) in accordance with the QuikDeck™ suspended access system, the present disclosure nevertheless is also intended to encompass embodiments that utilize other types of support subsystems, and nothing herein should be interpreted as indicating any requirement that the QuikDeck™ suspended access system or any of the particular support subsystem components or variations described herein be employed. Indeed, the present disclosure is intended to encompass work platform systems that only include one or more suspended subsystem components or that only include what can be considered a suspended subsystem, with that suspended subsystem being directly coupled to structures of interest such as the suspension bridge 100 without there being present any support subsystem whatsoever.

Additionally, regardless of the particular suspended subsystem or support subsystem components that are used, numerous other variations are intended to be encompass herein as well. For example, although the fully implemented work platform assembly 860 only includes a single platform level, in other embodiments there can be multiple levels of platform structures. Further, in some embodiments other types of components can be also included in the work platform system. For example, in some embodiments, a railing system can be attached to one or more portions of the work platform system (e.g., one or more portions of the support and/or suspended subsystems of the work platform system). Railings of such systems can be manufactured from a variety of materials, such as chain, cable (e.g., galvanized aircraft cable), line, and the like, among other things and, in still additional embodiments, railing standards can also be used to erect a work enclosure system. For example, tarps, sheeting, or the like can be attached to railing standards to enclose work area(s) for various purposes.

The materials out of which the work platform system 860 or other work platform systems in other embodiments can be formed can vary depending upon the embodiment. For example, suitable materials for components of such work platform systems can include metal (e.g., steel, aluminum, etc.), wood, plastic, composite, or other suitable materials. Also, such components can be made of items that are solid, corrugated, grated, smooth, or of other suitable configurations. For example, panel portions of such work platform assemblies can be made of wood sheeting, plywood, roof decking material, metal on a frame, grating, steel sheeting, and the like, among other things.

Further for example, each of the suspension chains of the suspended subsystem (e.g., the suspension chains 790) and support chains of the support subsystem (e.g., the support chains 220) can take the form of any of a variety of types of chains, including toothed chains, suspension wires or wire tendons, belts, or other support components depending upon the embodiment. Also, the wire tendons of the suspended system (e.g., the wire tendons of the pairs of wire tendons 230) can additionally take on any of a variety of forms of wires, cables, and similar flexible extending structures. Indeed, it should be appreciated that, depending upon the embodiment or circumstance, any of a variety of types of bendable or flexible linkages or extensions or flexible machine elements (or simply flexible elements) can be employed in the roles of each and every one of the suspension chains 790, support chains 220, and wire tendons 230, such as wire, wire rope, chain (or toothed chain), belt, or similar types of extensions or linkages or connectors.

Further in this regard, it should be noted that typically the extensions or linkages or connectors will be structures that are flexible and that have lengths along linear dimensions that are substantially greater than the widths and depths of those structures, where the widths and depths are themselves both small relative to the lengths and the widths and depths are themselves similar in size. Nevertheless, in some alternate embodiments, it is possible that the extensions or linkages or connectors can be structures having other characteristics including, for example, structures that have lengths that are substantially greater than their widths, as well as widths that are substantially greater than their depths (e.g., structures taking the form of ribbons). Also, it is possible in some cases that one or more of the extensions or linkages or connectors used as (or in place of) the suspension chains 790, support chains 220, and/or wire tendons 230 can be rigid rather than flexible.

In at least some embodiments, portions of the work platform system described herein can interface with, connect with, or interoperate with portions of conventional work platform systems. Also, in at least some embodiments, work personnel can extend, relocate, or remove components of the work platform system using only hand tools, and no mechanical tools, hoists, cranes, or other equipment is required to add to, or subtract from, existing components of the work platform system. In at least some embodiments, installation of the work platform system can be done, essentially, "in the air". That is, the work platform system can be erected and connected together "in the air", in a piece-by-piece order via the use of multiple pieces of lifting, or hoisting, equipment. That said, in alternate embodiments, it is possible also that one or more of the subsystems, portions, or components will be preassembled on the ground, or at a remote location, and then moved and hoisted as a pre-assembled module into the desired location.

It should also be understood that, in addition to the processes of implementation/installation and use described herein, the present disclosure is also intended to encompass other processes such as disassembly processes. For example, to the extent that a process for installing panel sections 750 is discussed above, and can involve a worker lowering one of the panels by of a lanyard or similar ropelike structure, disassembly can similarly involve tugging on a lanyard to raise up a previously-installed panel. In such circumstance, the lanyard would be attached to the handle support extension(s) of the panel section being removed that extend from the side strut of that panel section opposite the location of the work personnel pulling on the lanyard.

Therefore, although certain embodiments of the present disclosure have been shown and described in detail above, it should be understood that numerous changes and modifications can be made without departing from the scope of the appended claims. Among other things, it should be appreciated that the scope of the present disclosure is not limited to the number of constituting components, the materials thereof, the shapes thereof, the relative arrangement thereof, etc., as described above, but rather the above disclosures are simply provided as example embodiments.

Thus, it is specifically intended that the present invention not be limited to the embodiments and illustrations contained herein, but include modified forms of those embodiments including portions of the embodiments and combinations of elements of different embodiments as come within the scope of the following claims.

What is claimed is:

1. A work platform system for implementation in relation to a structure, the work platform system comprising:

a first flexible element and a second flexible element, wherein a respective first end of each of the flexible elements is coupled at least indirectly to a first support component and a respective second end of each of the flexible elements is coupled at least indirectly to a second support component; and a plurality of panel structures supported upon the flexible elements and substantially extending between the first flexible element and the second flexible element, wherein the panel structures are positioned in succession with one another so as to form a row of the panel structures extending along the flexible elements;

wherein each of the panel structures includes a respective first pair of opposed edges each extending substantially parallel to the flexible elements and a respective second pair of opposed edges each extending between the respective first pair of opposed edges, wherein a first of the panel structures includes a first support extension extending outward away from a first one of the respective second pair of opposed edges of the first panel structure, wherein the first support extension of the first panel structure includes a first formation into which a second one of the respective second pair of opposed edges of a second of the panel structures is positioned, the first formation serving to at least partly limit movement of the second panel structure relative to the first panel structure, wherein the second panel structure includes a second support extension extending outward away from the second one of the respective second pair of opposed edges, and wherein the second support extension includes a second formation into which the first one of the respective second pair of opposed edges of the first panel structure is positioned, the second formation serving to at least partly limit movement of the second panel structure relative to the first panel structure, wherein the first support extension is a U-shaped structure that includes an outwardly-extending segment extending outward away from the first one of the respective second pair of opposed edges in a direction substantially parallel to a panel structure surface of the first panel structure, an upwardly-extending segment extending from the outwardly-extending segment upward toward a plane of the panel structure surface, a longitudinally-extending segment extending longitudinally toward a further plane of a first one of the respective first pair of opposed edges of the first panel structure, a downwardly-extending segment extending downwardly away from the plane of the panel structure surface, and an inwardly-extending segment extending inwardly to the first one of the respective second pair of opposed edges, and wherein the first formation includes at least the upwardly-extending, longitudinally-extending, and downwardly-extending segments.

2. The work platform system of claim 1, wherein the first support extension is configured as a handle structure.

3. The work platform system of claim 1, wherein the first panel structure additionally includes a third support extension extending outward away from the first one of the respective second pair of opposed edges of the first panel structure, wherein the first support extension is at a first position that is closer to the first one of the respective first pair of opposed edges of the first panel structure than a second position at which the third support extension is located, wherein the second panel structure additionally includes a fourth support extension extending outward away from the second one of the respective second pair of opposed edges of the second panel structure, wherein the second support extension is at a third position that is closer to a second one of the respective first pair of opposed edges of the second panel structure than a fourth position at which the fourth support extension is located, and wherein the first, fourth, second, and third positions occur in succession in between the first and the second flexible elements.

4. The work platform system of claim 1, wherein the first support extension is positioned in a complementary shifted manner relative to an additional support extension extending outward away from an additional one of the respective second pair of opposed edges of the first panel structure.

5. The work platform system of claim 1, wherein the outwardly-extending and inwardly-extending segments include hook-shaped outer portions that are included in the first formation, and wherein each of the opposed edges of the first and second pairs of the first panel structure is formed by a respective tubular support strut extending underneath the panel structure surface.

6. The work platform system of claim 1, wherein the first support extension serves to assist in supporting the second panel structure relative to the first and second flexible elements.

7. The work platform system of claim 1, wherein each of the panel structures includes at least two additional support extensions extending outward from each of the respective first pair of opposed edges of the respective panel structure, and each of the additional support extensions includes a respective at least one indentation configured to receive either the first flexible element or the second flexible element when the respective panel structure is supported upon the flexible elements.

8. The work platform system of claim 1, further comprising a third flexible element, wherein a respective first end of the third flexible element is also coupled at least indirectly to the first support component and a respective second end of the third flexible element is coupled at least indirectly to the second support component; and an additional plurality of panel structures supported upon the second flexible element and the third flexible element, wherein the panel structures of the additional plurality of panel structures are positioned in succession with one another so as to form an additional row of the panel structures extending along the third flexible element.

9. The work platform system of claim 8, further comprising at least one cover section positioned in between at least one of the first plurality of panel structures and at least one of the additional plurality of panel structures, so as to cover over a portion of the second flexible element.

10. The work platform system of claim 1, further comprising a suspension component and a clamp structure to which the suspension component is attached, wherein the clamp structure is coupled to the first flexible element or the second flexible element so that the respective flexible element is supported by the suspension component.

11. The work platform system of claim 10, wherein the clamp structure includes at least a primary surface formation and a clasp component that is rotatably attached to the primary surface formation but locked in place relative to the primary surface formation.

12. The work platform system of claim 11, wherein the clasp component is configured to rotate from a first position in which the clasp component is unlocked to a second position in which the clasp component is locked in place relative to the primary surface formation by way of a post of the clasp component fitting into an orifice of the primary surface formation.

13. The work platform system of claim 11 wherein the clamp structure includes an additional clasp component that is also rotatably attached to the primary surface formation but locked in place relative to the primary surface formation.

14. The work platform system of claim 11, wherein the clamp structure is structured to permit at least one of securing and adjustment of the suspension component.

15. The work platform system of claim 14, wherein the suspension component is a chain that is configured to be secured or adjusted by way of a chain slot in the clamp structure.

16. The work platform system of claim 1, further comprising the first and second support components, which are respectively mounted on first and second portions of the structure.

17. A work platform system for implementation in relation to a structure, the work platform system comprising:

a first pair of flexible elements and a second pair of flexible elements, wherein a respective first end of each of the flexible elements is coupled at least indirectly to a first support component and a respective second end of each of the flexible elements is coupled at least indirectly to a second support component; and a plurality of panel structures supported upon the flexible elements and substantially extending between the first pair of flexible elements and the second pair of flexible elements, the panel structures positioned in succession with one another so as to form a row of the panel structures extending along the flexible elements, wherein each of the panel structures includes a respective first pair of opposed edges each extending substantially parallel to the flexible elements and a respective second pair of opposed edges each extending between the first pair of opposed edges; and a first support extension extending outward away from a first one of the respective second pair of opposed edges of a first panel structure of the plurality of panel structures, the first support extension of the first panel structure including a first formation into which a second one of the respective second pair of opposed edges of a second of the panel structures is positioned, the first formation serving to at least partly limit movement of the second panel structure relative to the first panel structure, wherein the first support extension is a U-shaped structure that includes an outwardly-extending segment extending outward away from the first one of the respective second pair of opposed edges in a direction substantially parallel to a panel structure surface of the first panel structure, an upwardly-extending segment extending from the outwardly-extending segment upward toward a plane of the panel structure surface, a longitudinally-extending segment extending longitudinally toward a further plane of a first one of the respective first pair of opposed edges of the first panel structure, a downwardly-extending segment extending downwardly away from the plane of the panel structure surface, and an inwardly-extending segment extending inwardly to the first one of the respective second pair of opposed edges, and wherein the first formation includes at least the upwardly-extending, longitudinally-extending, and downwardly-extending segments.

18. The work platform system of claim 17, wherein the first support extension is configured as a handle structure.

19. The work platform system of claim 17, further comprising a clamp structure configured to be coupled to a suspension component, the clamp structure coupled to at least one of the first pair of flexible elements and the second pair of flexible elements so that the at least one of the first pair of flexible elements and the second pair of flexible elements is or are supported by the suspension component.

20. The work platform system of claim 19, wherein the clamp structure includes at least a primary surface formation and a clasp component that is rotatably attached to the primary surface formation but locked in place relative to the primary surface formation; and wherein the clasp component is configured so that, when rotated to a first position, the clasp component fits between the flexible elements of the at least one of the first pair and the second pair and, when rotated to a second position the clasp component is locked in place relative to the primary surface formation by way of a post of the clasp component fitting into an orifice of the primary surface formation.

21. The work platform system of claim 20, wherein the clamp structure is structured to permit securing and adjustment of a suspension component, such as a chain, by way of an opening, such as a chain slot.

22. The work platform system of claim 17 wherein each of the panel structures includes first extensions that are supported by the flexible elements and second extensions that serve as supports and additionally serve to allow for an adjacent one of the panel structures to be implemented in relation to the respective panel structure.

23. The work platform system of claim 17, further comprising the first and second support components, which are respectively mounted on first and second portions of the structure.

24. The work platform system of claim 17, further comprising a second support extension extending outward away from the second one of the respective second pair of opposed edges of the second panel structure, and wherein the second support extension includes a second formation into which the first one of the respective second pair of opposed edges of the first panel structure is positioned, the second formation serving to at least partly limit movement of the second panel structure relative to the first panel structure.

25. The work platform system of claim 24, further comprising: (i) a third support extension extending outward away from the first one of the respective second pair of opposed edges of the first panel structure, wherein the first support extension is at a first position that is closer to the first one of the respective first pair of opposed edges of the first panel structure than a second position at which the third support extension is located, and (ii) a fourth support extension extending outward away from the second one of the respective second pair of opposed edges of the second panel structure, wherein the second support extension is at a third position that is closer to a second one of the respective first pair of opposed edges of the second panel structure than a fourth position at which the fourth support extension is located, and the first, fourth, second, and third positions occur in succession in between the first flexible elements and the second flexible elements.

26. The work platform system of claim 17, wherein the first support extension is positioned in a complementary shifted manner relative to an additional support extension extending outward away from an additional one of the respective second pair of opposed edges of the first panel structure.

27. The work platform system of claim 17, wherein the outwardly-extending and inwardly-extending segments include hook-shaped outer portions that are included in the first formation, and wherein each of the opposed edges of the first and second pairs of the first panel structure is formed by a respective support strut extending underneath the panel structure surface.

28. The work platform system of claim 27, wherein the first support extension serves to assist in supporting the second panel structure relative to the first and second pairs of flexible elements.

29. The work platform system of claim 17, wherein each of the panel structures includes at least two additional support extensions extending outward from each of the respective first pair of opposed edges of the respective panel structure, and each of the additional support extensions includes a respective pair of indentations configured to receive either the first pair of flexible elements or the second pair of flexible elements when the respective panel structure is supported upon the flexible elements.

30. The work platform system of claim 17, further comprising a third pair of flexible elements, wherein a respective first end of each of the flexible elements of the third pair is also coupled at least indirectly to the first support component and a respective second end of each of the flexible elements of the third pair is coupled at least indirectly to the second support component; and an additional plurality of panel structures supported upon the second pair of flexible elements and the third pair of flexible elements, wherein the panel structures of the additional plurality of panel structures are positioned in succession with one another so as to form an additional row of the panel structures extending along the third pair of flexible elements.

31. The work platform system of claim 30, further comprising at least one cover section positioned in between at least one of the first plurality of panel structures and at least one of the additional plurality of panel structures, so as to cover over portions of the second pair of flexible elements.

32. The work platform system of claim 30, further comprising a suspension component and a clamp structure to which the suspension component is attached, wherein the clamp structure is coupled to at least one of the first pair of flexible elements and the second pair of flexible elements so that the at least one of the first pair of flexible elements and the second pair of flexible elements is or are supported by the suspension component.

33. The work platform system of claim 32, wherein the clamp structure includes at least a primary surface formation and a clasp component that is rotatably attached to the primary surface formation but locked in place relative to the primary surface formation.

34. The work platform system of claim 33, wherein the clasp component is configured so that, when rotated to a first position, the clasp component fits between the flexible elements of the at least one of the first pair of flexible elements and the second pair of flexible elements and, when rotated to a second position the clasp component is locked in place relative to the primary surface formation by way of a post of the clasp component fitting into an orifice of the primary surface formation.

35. The work platform system of claim 33, wherein the clamp structure includes an additional clasp component that is also rotatably attached to the primary surface formation but locked in place relative to the primary surface formation.

36. The work platform system of claim 35, wherein the clasp component of the clamp structure further supports an end or end portion of at least a respective one of the panel structures.

37. The work platform system of claim 17, further comprising the first and second support components, which are respectively mounted on first and second portions of the structure.

38. A work platform system for implementation in relation to a structure, the work platform system comprising:

a first flexible element and a second flexible element, wherein a respective first end of each of the flexible elements is coupled at least indirectly to a first support component and a respective second end of each of the flexible elements is coupled at least indirectly to a second support component; and a plurality of panel structures supported upon the flexible elements and substantially extending between the first flexible element and the second flexible element, wherein the panel structures are positioned in succession with one another so as to form a row of the panel structures extending along the flexible elements;

wherein each of the panel structures includes a respective first pair of opposed edges each extending substantially parallel to the flexible elements and a respective second pair of opposed edges each extending between the respective first pair of opposed edges, wherein a first of the panel structures includes a first support extension extending outward away from a first one of the respective second pair of opposed edges of the first panel structure, wherein the first support extension of the first panel structure includes a first formation into which a second one of the respective second pair of opposed edges of a second of the panel structures is positioned, the first formation serving to at least partly limit movement of the second panel structure relative to the first panel structure, wherein the first support extension is a U-shaped structure that includes an outwardly-extending segment extending outward away from the first one of the respective second pair of opposed edges in a direction substantially parallel to a panel structure surface of the first panel structure, an upwardly-extending segment extending from the outwardly-extending segment upward toward a plane of the panel structure surface, a longitudinally-extending segment extending longitudinally toward a further plane of a first one of the respective first pair of opposed edges of the first panel structure, a downwardly-extending segment extending downwardly away from the plane of the panel structure surface, and an inwardly-extending segment extending inwardly to the first one of the respective second pair of opposed edges, and wherein the first formation includes at least the upwardly-extending, longitudinally-extending, and downwardly-extending segments.

39. The work platform system of claim 38, wherein the first support extension serves to assist in supporting the second panel structure relative to the first and second flexible elements.

40. A work platform system for implementation in relation to a structure, the work platform system comprising:

a first flexible element and a second flexible element, wherein a respective first end of each of the flexible elements is coupled at least indirectly to a first support component and a respective second end of each of the flexible elements is coupled at least indirectly to a second support component; and a plurality of panel structures supported upon the flexible elements and substantially extending between the first flexible element and the second flexible element, wherein the panel structures are positioned in succession with one another so as to form a row of the panel structures extending along the flexible elements;

wherein each of the panel structures includes a respective first pair of opposed edges each extending substantially parallel to the flexible elements and a respective second pair of opposed edges each extending between the respective first pair of opposed edges, wherein a first of the panel structures includes a first support extension extending outward away from a first one of the respective second pair of opposed edges of the first panel structure, wherein the first support extension of the first panel structure includes a first formation into which a second one of the respective second pair of opposed edges of a second of the panel structures is positioned, the first formation serving to at least partly limit movement of the second panel structure relative to the first panel structure, wherein the second panel structure includes a second support extension extending outward away from the second one of the respective second pair of opposed edges, and wherein the second support extension includes a second formation into which the first one of the respective second pair of opposed edges of the first panel structure is positioned, the second formation serving to at least partly limit movement of the second panel structure relative to the first panel structure, wherein the first support extension is a U-shaped structure that includes an outwardly-extending segment extending outward away from the first one of the respective second pair of opposed edges in a direction substantially parallel to a panel structure surface of the first panel structure, an upwardly-extending segment extending from the outwardly-extending segment upward toward a plane of the panel structure surface, a longitudinally-extending segment extending longitudinally toward a further plane of a first one of the respective first pair of opposed edges of the first panel structure, a downwardly-extending segment extending downwardly away from the plane of the panel structure surface, and an inwardly-extending segment extending inwardly to the first one of the respective second pair of opposed edges, wherein the first formation includes at least the upwardly-extending, longitudinally-extending, and downwardly-extending segments, wherein each of the panel structures includes at least two additional support extensions extending outward from each of the respective first pair of opposed edges of the respective panel structure, and each of the additional support extensions includes a respective at least one indentation configured to receive either the first flexible element or the second flexible element when the respective panel structure is supported upon the flexible elements, and wherein the first support extension serves to assist in supporting the second panel structure relative to the first and second flexible elements.

41. The work platform system of claim 40, wherein the first support extension is configured as a handle structure.

42. A work platform system for implementation in relation to a structure, the work platform system comprising:

a first pair of flexible elements and a second pair of flexible elements, wherein a respective first end of each of the flexible elements is coupled at least indirectly to a first support component and a respective second end of each of the flexible elements is coupled at least indirectly to a second support component; and a plurality of panel structures supported upon the flexible elements and substantially extending between the first pair of flexible elements and the second pair of flexible elements, the panel structures positioned in succession with one another so as to form a row of the panel structures extending along the flexible elements, wherein each of the panel structures includes a respective first pair of opposed edges each extending substantially parallel to the flexible elements and a respective second pair of opposed edges each extending between the first pair of opposed edges;

a first support extension extending outward away from a first one of the respective second pair of opposed edges of the first panel structure, the first support extension of the first panel structure including a first formation into which a second one of the respective second pair of opposed edges of a second of the panel structures is positioned, the first formation serving to at least partly limit movement of the second panel structure relative to the first panel structure; and at least one cover section, wherein at least one of the panel sections is held at least substantially in place at least partly by way of the cover section, wherein the cover section comprises a deck retainer that is fixedly attached to a deck retainer clamp, and wherein the deck retainer clamp includes:

a main outer shell having a roof and first and second side walls, respectively, extending downwards from each of two sides of the roof, respectively, a flat internal compression structure that includes two ear extensions that respectively fit into two complementary slots formed near the bottom edges of each of the two side walls.

43. The work platform system of claim 42, wherein the deck retainer clamp includes indentations for receiving at least one of the first and second pairs of flexible elements, respectively.

44. The work platform system of claim 43, further comprising a containment bracket that is secured, at least indirectly, to the deck retainer clamp.

45. A work platform system for implementation in relation to a structure, the work platform system comprising:

a plurality of panel structures supported upon a plurality of support elements including first and second support elements and substantially extending between the first support element and the second support element, wherein the panel structures are positioned in succession with one another so as to form a row of the panel structures;

wherein each of the panel structures includes a respective first pair of opposed edges and a respective second pair of opposed edges each extending between the respective first pair of opposed edges, wherein a first of the panel structures includes a first support extension extending outward away from a first one of the respective second pair of opposed edges of the first panel structure, wherein the first support extension of the first panel structure includes a first formation into which a second one of the respective second pair of opposed edges of a second of the panel structures is positioned, the first formation serving to at least partly limit movement of the second panel structure relative to the first panel structure, wherein the first support extension is a U-shaped structure that includes an outwardly-extending segment extending outward away from the first one of the respective second pair of opposed edges in a direction substantially parallel to a panel structure surface of the first panel structure, an upwardly-extending segment extending from the outwardly-extending segment upward toward a plane of the panel structure surface, a longitudinally-extending segment extending longitudinally toward a further plane of a first one of the respective first pair of opposed edges of the first panel structure, a downwardly-extending segment extending downwardly away from the plane of the panel structure surface, and an inwardly-extending segment extending inwardly to the first one of the respective second pair of opposed edges, and wherein the first formation includes at least the upwardly-extending, longitudinally-extending, and downwardly-extending segments.

46. The work platform system of claim 45, wherein the second panel structure includes a second support extension extending outward away from the second one of the respective second pair of opposed edges, and wherein the second support extension includes a second formation into which the first one of the respective second pair of opposed edges of the first panel structure is positioned, the second formation serving to at least partly limit movement of the second panel structure relative to the first panel structure.

47. The work platform system of claim 46, wherein the first panel structure additionally includes a third support extension extending outward away from the first one of the respective second pair of opposed edges of the first panel structure, wherein the first support extension is at a first position that is closer to the first one of the respective first pair of opposed edges of the first panel structure than a second position at which the third support extension is located, wherein the second panel structure additionally includes a fourth support extension extending outward away from the second one of the respective second pair of opposed edges of the second panel structure, wherein the second support extension is at a third position that is closer to a second one of the respective first pair of opposed edges of the second panel structure than a fourth position at which the fourth support extension is located, and wherein the first, fourth, second, and third positions occur in succession in between the first and the second flexible elements.

48. The work platform system of claim 45, wherein the first support extension is configured as a handle structure.

49. The work platform system of claim 45, wherein the first support element is a first flexible element and the second support element is a second flexible element, and the row of panel structures extend along the flexible elements.

50. The work platform system of claim 49, further comprising a suspension component and a clamp structure to which the suspension component is attached, wherein the clamp structure is coupled to the first flexible element or the second flexible element so that the respective flexible element is supported by the suspension component.

* * * * *